US006522058B2

(12) United States Patent
Nakamura et al.

(10) Patent No.: US 6,522,058 B2
(45) Date of Patent: Feb. 18, 2003

(54) COLOR CATHODE RAY TUBE

(75) Inventors: Tomoki Nakamura, Mobara (JP); Hirotsugu Sakamoto, Chiba (JP); Shinichi Kato, Mobara (JP)

(73) Assignees: Hitachi Ltd., Tokyo (JP); Hitachi Device Engineering Co., Mobara (JP)

( * ) Notice: Subject to any disclaimer, the term of this patent is extended or adjusted under 35 U.S.C. 154(b) by 133 days.

(21) Appl. No.: 09/834,114

(22) Filed: Apr. 12, 2001

(65) Prior Publication Data

US 2002/0014823 A1 Feb. 7, 2002

(30) Foreign Application Priority Data

Aug. 4, 2000 (JP) ..... 2000-236539

(51) Int. Cl.[7] ..... H01J 29/50

(52) U.S. Cl. ..... 313/414; 313/412

(58) Field of Search ..... 313/414, 412, 313/413, 426, 432, 439

*Primary Examiner*—Vip Patel

(74) *Attorney, Agent, or Firm*—Milbank, Tweed, Hadley & McCloy LLP

(57) ABSTRACT

The present invention provides a color cathode ray tube which can improve the focusing characteristics in a wide range of a phosphor screen by setting the total length of a focus electrode divided in multi-stages within a given value and properly selecting the mounting position and the sensitivity of an electrostatic quadrupole lens. A focus electrode G5 which constitutes a final-stage main lens includes a plurality of electrode members G5-1, G5-2, G5-3, G5-4 which constitute an electrostatic quadrupole lens and a curvature-of-image-field correction lens, and assuming the distance from a surface of the focus electrode G5 which faces an anode G6 in an opposed manner to the final-stage main lens-side position of the electrostatic quadrupole lens as L2, a relationship of $7.55 \leqq L2 \leqq 11.5$ is set.

20 Claims, 18 Drawing Sheets

COLOR CATHODE RAY TUBE

BACKGROUND OF THE INVENTION

1. Field of the Invention

The present invention relates to a cathode ray tube, and more particularly to a color cathode ray tube having an electron gun which is capable of obtaining a favorable focusing in a wide phosphor screen without increasing a focus voltage which controls the correction of astigmatism associated with the deflection of electron beams and the correction of image curvature.

2. Related Art

In a cathode ray tube such as a television picture tube, a monitor tube of an information terminal equipment, other display tube or the like, electron beams emitted from an electron gun scan a phosphor screen on which a phosphor is formed (hereinafter, sometimes simply called "screen") in two directions consisting of a horizontal direction and a vertical direction to form given images.

With respect to an electron gun used in this type of color cathode ray tube, to obtain the favorable focus characteristics on the entire region of the phosphor screen, it is necessary to perform the control of shape of beam spots landed on the phosphor screen corresponding to the deflection angle of emitted electron beams.

Recently, a monitor or a television picture tube which mounts a flat tube having an outer surface of a panel thereof flattened (flat-panel type color cathode ray tube) has been commercialized. Particularly, with respect to a flat tube having a large screen which has an effective diameter of 51 cm or the like in the diagonal direction, the focusing difference between the central portion and the peripheral portion of the screen becomes large.

As a countermeasure to decrease this focusing difference, there has been known a method in which a focus electrode which constitutes an electron gun is divided into a plurality of electrode members and a focus voltage of a fixed voltage and other focus voltage which is produced by superposing a dynamic voltage which is changed in synchronism with a deflection quantity to the fixed voltage are applied to the focus electrode to form an electrostatic quadrupole lens and a curvature-of-image-field correction lens whereby the deterioration of focusing in the periphery of the screen derived from the increase of the deflection angle can be reduced.

FIG. 19 is a schematic view for explaining a general lens constitution of an electron gun which is applied to a color cathode ray tube. In the drawing, BS indicates a beam generating part, PFL indicates a prefocus lens, FL indicates a front-stage main focus lens, IL indicates a curvature-of-image-field correction lens, ML indicates a rear-stage main focus lens (also called "final-stage main focus lens), and SC indicates a phosphor screen.

Respective lenses described above are arranged in the direction of the phosphor screen SC from the beam generating part BS side along a tube axis Z—Z These lenses focus electron beams B generated by the beam generating part BS, then accelerate the electron beams B and finally make the electron beams B impinge on the phosphor screen SC so as to form electron beam spots (simply called "beam spots" hereinafter).

To be more specific, the above-mentioned electron gun is constituted by the beam generating part (triode part) which is constituted by a cathode (usually called "K"), a control electrode (usually called "G1") and an accelerating electrode (usually called "G2") and generates a plurality of electron beams, and a main lens part which is made of focus electrodes (usually called "G3", "G4" "G5") and an anode (usually called "G6") and focus the electron beams generated by the beam generating part toward the phosphor screen.

Here, the electron gun adopts a multi-stage dynamic focusing (MDF) system where the focus electrode (G5) is divided into a plurality of electrode members. By applying a fixed focus voltage and a dynamic correction voltage which is produced by superposing a dynamic voltage which is changed in synchronism with a deflection quantity to the divided electrode members, an electrostatic quadrupole lens and a curvature-of-image-field correction lens which are provided for ensuring desired focusing characteristics in a wide range of the phosphor screen are formed. Most of the conventional electron guns adopt the non-multi-stage dynamic focusing.

FIG. 20 is an explanatory view of the focus voltage applied to the focus electrode divided into a plurality of electrode members. Further, FIG. 21 is an explanatory view of an output voltage of a flyback transformer which generates two focus voltages.

As shown in FIG. 20, the focus electrode G5 of the electron gun is divided in multi-stages (here, three stages consisting of electrode members A, B and C) so as to constitute an electron gun of a composite lens type and the electrostatic quadrupole lens and the curvature-of-image-field correction lens are formed among the electrode members A, B and C. The curvature-of-image-field correction lens is provided for correcting the difference of distance from the center of deflection to the phosphor screen and is usually arranged at a position closer to the phosphor screen than the electrostatic quadrupole lens.

The electrostatic quadrupole lens controls the cross section of the beam spots which pass through the electrostatic quadrupole lens so as to reduce the shape of the beam spot on a phosphor screen into a shape similar to a circle.

The first fixed voltage Vf1 is applied to the electrode member B and other focus voltage (Vf2+dVf) which is produced by superposing a dynamic voltage dVf which is changed in synchronism with a deflection quantity to the second fixed voltage Vf2 is applied to the electrode members A and C.

The above-mentioned focus voltages Vf1, Vf2+dVf are generated by the flyback transformer FBT shown in FIG. 21. Here, Eb indicates an anode voltage (maximum voltage) which is applied to the anode G6, Ec2 indicates a prefocus voltage of approximately 600V applied to other electrodes (G2, G4) of the electron gun.

FIG. 22 is an explanatory view of the focus voltage applied to the electrode members of the divided focus electrode, wherein 1V indicates 1 vertical deflection cycle (1 frame cycle or 1 field cycle) and 1H indicates 1 horizontal deflection cycle.

When the dynamic voltage dVf is increased, that is, when the deflection quantity of the electron beams is large (at the time of deflecting the electron beams toward the peripheral portion of the screen), the potential difference at the curvature-of-image-field correction lens becomes small so that the intensity of the lens is decreased. Accordingly, the force to focus the electron beams becomes weak at the time of deflecting the electron beams so that the image curvature is corrected.

This type of conventional technique is, for example, disclosed in Japanese Laid-open Patent Publication 43532/1992 and Japanese Laid-open Patent Publication 161309/1995.

With respect to the conventional technique, particularly Japanese Laid-open Patent Publication 43532/1992, a focus electrode disposed close to an anode is divided into a plurality of first electrode members and a plurality of second electrode members, wherein the first electrode member and the second electrode member are alternately arranged in the electron beam advancing direction. Then, the first electrode member and the second electrode member form a curvature-of-image-field correction lens in the state that the first electrode member and the second electrode member are made electrically independent from each other to form an electron lens which changes the intensity thereof in synchronism with the deflection of the beams between the first electrode member and the second electrode member.

Further, a non-axially-symmetric electron lens for correcting astigmatism which deforms the cross-sectional shape of the electron beams due to the above-mentioned fluctuating dynamic voltage is formed adjacent to a main lens so that even when the fluctuation of the focus voltages is suppressed at a low level, a favorable image can be obtained on the whole screen.

SUMMARY OF THE INVENTION

However, the electron gun which uses the multi-stage focus electrode has the total length thereof elongated so that although the diameter of the beam spots on the screen becomes small, it is necessary to increase the focus voltage. For example, with respect to a flat type color cathode ray tube having a screen diagonal dimension of 51 cm and a deflection angle of 90 degrees, when the length of the focus electrode is increased by 1 mm, the focus voltage is elevated by approximately 0.36%.

Although the focus voltage is generated by the flyback transformer, usually the rated output voltage range of the flyback transformer which is used as a power supply of the cathode ray tube of this type is approximately 28%±2% of an anode voltage. Accordingly, when the focus voltage is increased by elongating the focus electrode, the flyback transformer of a general use can not cope with the increased focus voltage. Therefore, the lowering of the focus voltage has been one of the tasks to be solved by the present invention.

It is a typical object of the present invention to provide a color cathode ray tube having an electron gun which improves the focusing characteristics in a wide region of a phosphor screen by setting the total length of a focus electrode divided in multi-stages within a given value and by properly selecting the mounting position and the sensitivity of an electrostatic quadrupole lens.

To achieve the above-mentioned object, according to a first aspect of the present invention, in a typical constitution of the present invention, a focus electrode includes a plurality of electrode members which constitute an electrostatic quadrupole lens which changes the cross-sectional shape of electron beams in synchronism with the deflection of the electron beams and an electron lens whose focusing force is fluctuated in synchronism with the deflection of the electron beams, and assuming the distance from an anode-side end portion of the focus electrode to an anode-side end portion of the electrostatic quadrupole lens as L2 (mm), the relationship of $7.55 \leqq L2 \leqq 11.5$ is set.

According to a second aspect of the present invention, with respect to the above-mentioned focus electrode, in a surface of one electrode member which constitutes the electrostatic quadrupole lens and faces the other electrode member in an opposed manner, longitudinally elongated electron beam passing apertures which have a long axis in the vertical direction are formed, on a surface of the other electrode member which constitutes the electrostatic quadrupole lens and faces one electrode member in an opposed manner, a plural pairs of horizontal correction electrode plates are formed such that the electrode plates sandwich a plurality of respective electron beams from the vertical direction, the electrode plates are protruded in the tube axis direction toward one electrode member, and the electrode plates make protruding ends thereof inserted into electron beam passing apertures of one electrode member in the vicinity of both ends of the apertures in the long axis direction, and assuming the electrode length in the tube axis direction of the horizontal correction electrode plates as L5 and the distance in the vertical direction of a pair of horizontal correction electrode plates as L6, the relationship of $0.0206 \leqq L5/(L6^{2.7}) \leqq 0.0306$ is set.

According to a third aspect of the present invention, with respect to the above-mentioned focus electrode, in a surface of one electrode member which constitutes the electrostatic quadrupole lens and faces the other electrode member in an opposed manner, longitudinally elongated electron beam passing apertures which have a long axis in the vertical direction are formed, in a surface of the other electrode member which forms the electrostatic quadrupole lens and faces one electrode member in an opposed manner, a laterally elongated electron beam passing aperture which has a horizontal long axis is formed, and assuming the distance from the surface of the focus electrode which faces the anode in an opposed manner to the anode-side position of the electrostatic quadrupole lens as L2 (mm), the relationship of $7.55 \leqq L2 \leqq 11.5$ is set.

According to a fourth aspect of the present invention, with respect to the above-mentioned focus electrode, on a surface of one electrode member which constitutes the electrostatic quadrupole lens and faces the other electrode member in an opposed manner, vertical correction electrode plates which sandwich a plurality of respective electron beams from the horizontal direction and are protruded along the tube axis toward the opposing other electrode member are formed, and on a surface of the other electrode member which constitutes the electrostatic quadrupole lens and faces one electrode member in an opposed manner, horizontal correction electrode plates which sandwich a plurality of respective electron beams from the vertical direction, are protruded along the tube axis toward one electrode member and are superposed with the vertical correction electrode plates are formed, and assuming the electrode length in the tube axis direction of the vertical correction electrode plates as L3 and the electrode length in the tube axis direction of the horizontal correction electrode plates as L4, the relationship of $2.18 \leqq (L3+L4)/2 \leqq 2.78$ is set.

According to a fifth aspect of the present invention, when the distance between a surface of one electrode member which forms the electrostatic quadrupole lens and faces the other electrode member in an opposed manner and a surface of the other electrode member which forms the electrostatic quadrupole lens and faces one electrode member in an opposed manner is set to not more than 1 mm, or when the width of end portions in the long axis direction (longitudinally up-and-down direction) of the longitudinally elongated electron beam passing apertures formed in the surface of one electrode member which faces the other electrode member in an opposed manner is set to W1 and the width of end portions in the long axis direction (laterally left-and-right direction) of the laterally elongated electron beam passing apertures formed in the surface of the other electrode member which faces one electrode member in an opposed manner is set to W2, the relationship of $2.00 \leqq (W1+W2)/2 \leqq 3.60$ is set.

Due to the above-mentioned constitution, it becomes possible to obtain a favorable focusing in a wide range of current area and in a wide range of screen area. Further, in the limited total length of the focus electrode, the mounting position and the sensitivity of the electrostatic quadrupole lens can be properly set and hence, the focusing characteristics of the electron gun can be improved in a wide area of the phosphor screen.

The present invention is not limited to the above-mentioned constitution and the constitutions of embodiments which are explained hereinafter and various modification are conceivable without departing from the technical concept of the present invention.

DESCRIPTION OF THE PREFERRED EMBODIMENTS

Preferred embodiments of the present invention are explained in detail hereinafter in conjunction with attached drawings.

Figure 1:
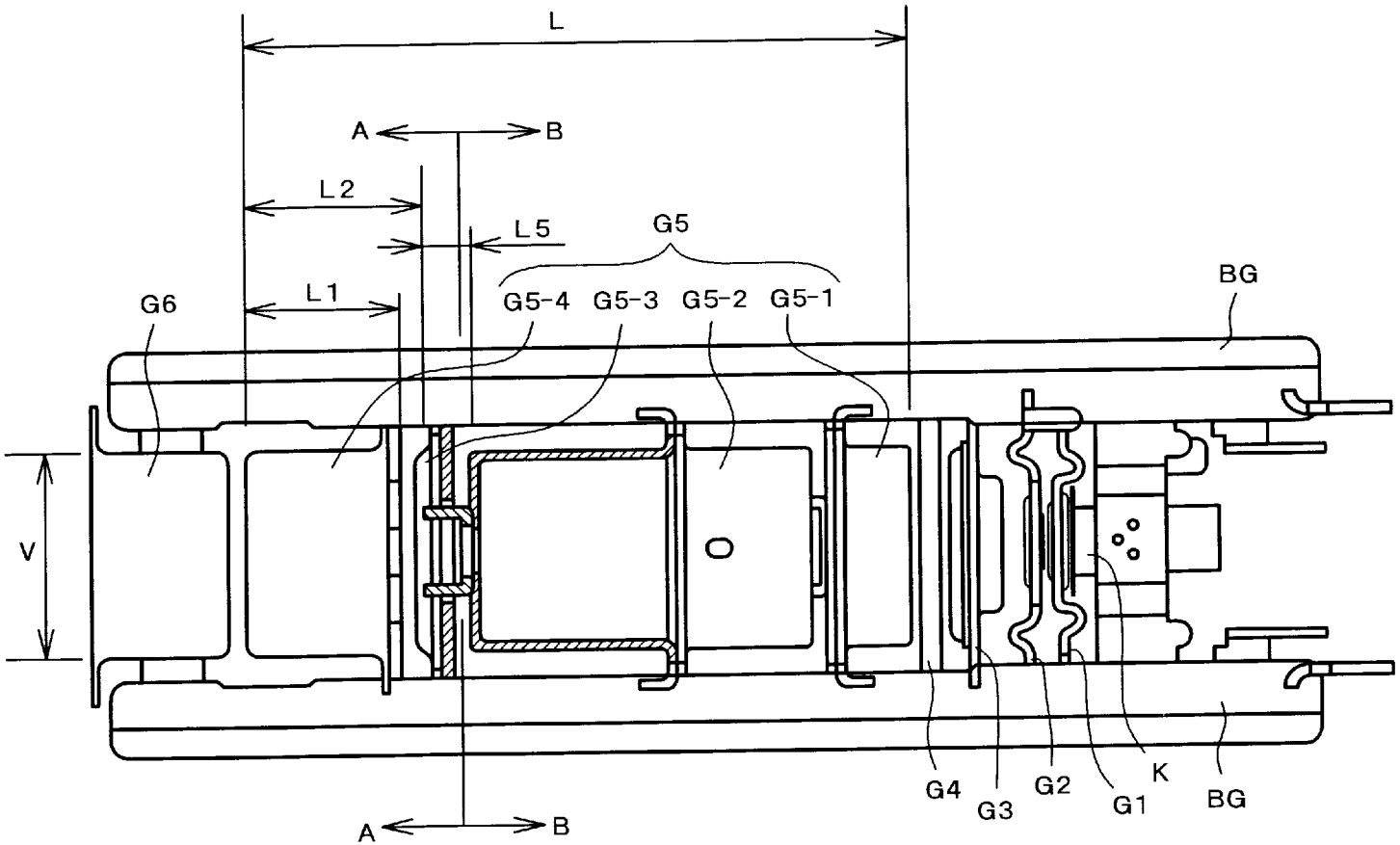
FIG. 1 is a side view with a part in cross section for explaining the constitution of a first embodiment of an electron gun used in a color cathode ray tube according to the present invention.

FIG. 1 is a side view with a part in cross section for explaining the constitution of a first embodiment of an electron gun which is applied to a color cathode ray tube according to the present invention.

This electron gun includes an electron beam generating part which is comprised of a cathode K, a first electrode G1 which constitutes a control electrode and a second electrode G2 which constitutes an accelerating electrode, a prefocus lens which is comprised of the second electrode G2 and a third electrode G3, a front-stage main lens which is comprised of a third electrode G3, a fourth electrode G4 and a fifth electrode G5, and a rear-stage main lens (final-stage main lens) which is comprised of the fifth electrode G5 which constitutes a final focus electrode and a sixth electrode G6 which constitutes an anode electrode.

These respective electrodes are embedded in a pair of beading glasses (multi-form glass) BG and are fixedly secured in a given arrangement. Although a so-called "a shield cap" is mounted on the distal end of the sixth electrode G6, such constitution is omitted from the drawing.

The fifth electrode G5 is divided into a first electrode member G5-1, a second electrode member G5-2, a third electrode member G5-3 and a fourth electrode member G5-4. Hereinafter, the fourth electrode member G5-4 of the fifth electrode G5 which faces the sixth electrode G6 in an opposed manner and constitutes a final-stage main lens is also called "G5 top electrode".

The electrostatic quadrupole lenses are formed between the first electrode member G5-1 and the second electrode member G5-2 as well as between the second electrode member G5-2 and the third electrode member G5-3, while a curvature-of-image-field correction lens is formed between the third electrode member G5-3 and the fourth electrode member G5-4 which constitutes the G5 top electrode. Here, L indicates the total length (mm) of the fifth electrode G5.

Figure 2A:
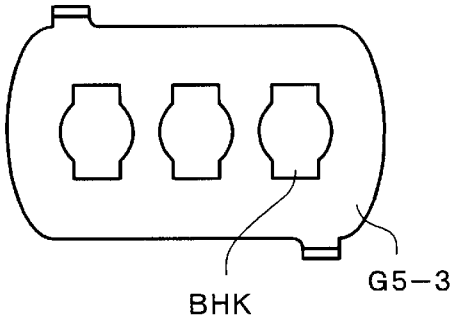
FIG. 2A and FIG. 2B are plan views of electrodes constituting an electrostatic quadrupole lens in the electron gun shown in FIG. 1.
Figure 2B:
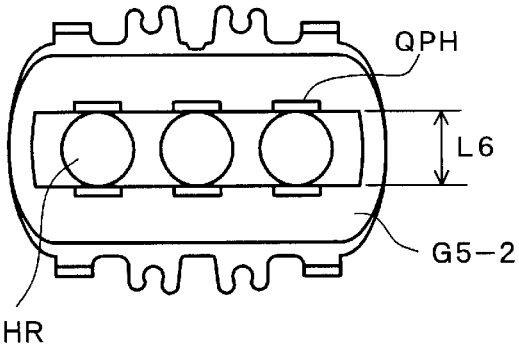

FIG. 2A and FIG. 2B are front views of the electrodes which constitute the electrostatic quadrupole lenses of the electron gun shown in FIG. 1. FIG. 2A is a front view which sees the third electrode member G5-3 of the fifth electrode G5 which forms the electrostatic quadrupole lens in the direction of an arrow A—A in FIG. 1 and FIG. 2B is a front view which sees the second electrode member G5-2 of the fifth electrode G5 which forms the electrostatic quadrupole lens in the direction of an arrow B—B in FIG. 1.

The beam generating part which generates a plurality of (three in this embodiment) of electron beams is constituted by the cathode K, the control electrode (first electrode) G1 and the acceleration electrode (second electrode) G2. By passing through the front-stage main lens which is constituted by the third electrode G3, the fourth electrode G4 and the neighboring first electrode member G5-1 of the fifth electrode and the fifth electrode G5 constituted by the first electrode G5-1 to the G5 top electrode G5-4, electron beams generated by the beam generating part receive the focusing action and the astigmatism correction action. The electron beams which are focused in the front stage is further focused and accelerated by the final-stage main lens formed in an opposing gap defined between the G5 top electrode G5-4 of the fifth electrode G5 and the sixth electrode G6 and then are impinged on the phosphor screen.

The first electrostatic quadrupole lens is formed between the first electrode member G5-1 and the second electrode member G5-2 of the fifth electrode G5. Further, the second electrostatic quadrupole lens is formed between the second electrode member G5-2 and the third electrode member G5-3 of the fifth electrode G5.

Further, the curvature-of-image-field correction lens is formed between third electrode member G5-3 and the fourth electrode member G5-4.

Then, the top electrode G5-4 of the fifth electrode G5 which forms the final-stage main lens is constituted by a cup-shaped electrode, wherein when the vertical-direction diameter of an aperture of the cup-shaped electrode which faces the sixth electrode G6 in an opposed manner is set to V (mm) and the total length in the tube axis direction of the fifth electrode G5 is set to L (mm), the relationship between V and L is set as follows.

$$L \leqq 4.7V - 9.3$$

The relationship between these L and V is an inequality which defines the length of the focus electrode capable of coping with the rated focus voltage (28% of anode voltage) generated by a flyback transformer of general use. The focus voltage is proportional to the length of the focus electrode and is inversely proportional to the lens aperture diameter. That is, even when the total length L is elongated by dividing the fifth electrode G5 which constitutes the final focus electrode for forming the final-stage main lens into a plurality of electrode members, the increase of the focus voltage can be suppressed by increasing the vertical diameter V of the fifth electrode G5 which constitutes the aperture diameter of the final-stage lens. By constituting the focus electrode such that the inequality is satisfied, the flyback transformer of general use can be applied and hence, in a TV picture tube or a display monitor, it is unnecessary to newly design a focusing circuit so that the electric compatibility can be ensured.

Further, the focus voltage difference between a high brightness screen and a low brightness screen is changed corresponding to the length of the focus electrode. Accordingly, to make the just focus voltage difference at the cathode current of 0.1 mA and 0.5 mA fall within ±30 V, the range of the total length L (mm) of the fifth electrode G5 is set to $31 \leqq L \leqq 43$. When the just focus voltage difference of the cathode current at the high and low areas falls within ±30 V, the clarity of the image is ensured in the wide range of the brightness area.

Further, the sixth electrode G6 which forms the main lens is also formed of a cup-shaped electrode and it is usual that the vertical direction diameter of the aperture which faces the G5 top electrode G5-4 of the cup-shaped electrode is also set to V (mm) as in the case of the top electrode G5-4 of the fifth electrode G5.

In this embodiment, the distance L2 from a surface of the G5 top electrode G5-4 which constitutes the final-stage main focus lens and which faces the sixth electrode in an oppose manner to an end portion of the electrostatic quadrupole lens at the phosphor screen side is set as follows.

$$7.55 \leqq L2 \leqq 11.5$$

With respect to the fifth electrode G5 which constitutes the above-mentioned focus lens, electron beam passing apertures BHK of a key-hole shape having a long axis in the vertical direction is formed in a surface of the third electrode member G5-3 which constitutes one electrode forming the electrostatic quadrupole lens and faces the second electrode member G5-2 in an opposed manner.

Further, on a surface of the second electrode member G5-2 of the fifth electrode G5 which constitutes the other electrode forming the electrostatic quadrupole lens and faces the third electrode member G5-3 in an opposed manner, a plural pairs of horizontal correction electrode plates QPH are formed such that the electrode plates QPH respectively sandwich a plurality of (three in this embodiment) electron beams (electron beam passing apertures BHR) from the vertical direction and the electrode plates QPH are protruded in the tube axis direction toward the third electrode member G5-3 which constitutes the above-mentioned one electrode.

Further, the horizontal correction electrode plates QPH make protruding ends thereof inserted into both ends in the long axis direction of the key-hole shaped electron beam passing apertures BHK having a long axis in the vertical direction which are formed on a surface of the third electrode member G5-3 of the fifth electrode G5 which faces the second electrode member G5-2 in an opposed manner thus forming the electrostatic quadrupole lens.

Then, assuming the electrode length in the tube axis direction of the horizontal correction electrode plates QPH as L5 and the distance in the vertical direction of a pair of horizontal correction electrode plates QPH as L6, a following relationship is set between them.

$$0.0206 \leqq L5/(L6^{2.7}) \leqq 0.0306$$

The calculation basis of this relationship equation will be explained later.

On the other hand, assuming the total length in the tube axis direction of the fifth electrode G5 as L (mm) and the vertical direction diameter of the apertures of the top electrode G5-4 of the fifth electrode G5 which faces the sixth electrode G6 as V, a following relationship is set between them.

$$31 \leqq L \leqq 4.7V - 9.3 \leqq 43$$

Due to such a constitution, the sensitivity of the electrostatic quadrupole lens is optimized and the favorable focusing characteristics can be obtained in the wide area of the phosphor screen. Further, by setting the total length L in the tube axis direction of the fifth electrode G5 in the range defined by the above-mentioned relationship equation, it becomes possible to set the focus voltage within a fixed range so that the just focusing can be achieved in the wide area of the screen.

Figure 3A:
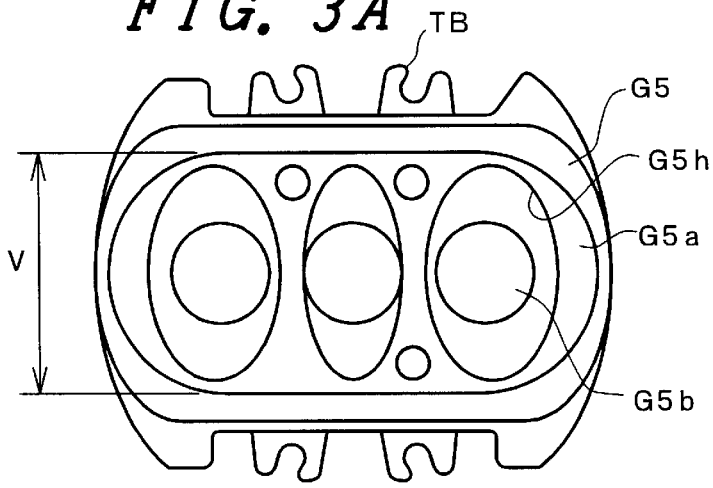
FIG. 3A and FIG. 3B are explanatory views of a top electrode constituting a fifth electrode of the electron gun shown in FIG. 1.
Figure 3B:
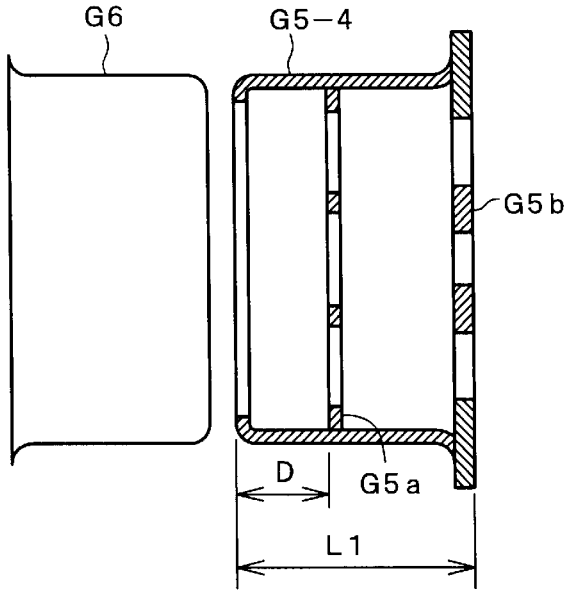

Subsequently, the basis or the reason why the above-mentioned advantageous effects of the embodiment can be obtained is explained. As shown in FIG. 3A and FIG. 3B, this type of the electron gun is provided with cup-shaped electrodes respectively having single apertures of a race track shape at one ends thereof and plate-like inner electrodes.

That is, FIG. 3A and FIG. 3B are explanatory views of the G5 top electrode G5-4 which constitutes the fifth electrode G5 of the electron gun shown in FIG. 1, wherein FIG. 3A is a front view of the G5 top electrode G5-4 as seen from the sixth electrode G6 side of the fifth electrode G5 and FIG. 3B is a cross-sectional view of the G5 top electrode G5-4 together with the sixth electrode G6 for explaining the inner structure of the G5 top electrode G5-4.

The G5 top electrode G5-4 is provided with a plate-like electrode (inner electrode) G5*a* in the inside of the cup-shaped electrode in the same manner as the sixth electrode G6. The inner electrode G5*a* includes three electron beam passing apertures G5*h* arranged in the horizontal direction. Further, a guide electrode G5*b* having three electron beam passing apertures are provided to the cathode K side of the G5 top electrode G5-4.

In general, in case of an electron gun which is accommodated in a color cathode ray tube having a neck diameter of 29.1 mm, a retraction quantity D of the plate-like inner electrode G5*a* mounted in the inside of the G5 top electrode G5-4 from a bottom portion of the sixth electrode G6 is approximately 3.5 mm–4.5 mm.

When the electrode length L1 of the G5 top electrode G5-4 is short, the race-track-shaped single electron beam passing aperture formed in the end portion of the G5 top electrode G5-4 disposed adjacent to the sixth electrode G6 and three electron beam passing apertures of the guide electrode G5*b* formed in the end portion of the G5 top electrode G5-4 adjacent to the cathode K come close to the inner electrode G5*a* and affect the characteristics of the electron gun. An electric field of the main lens formed between the fourth electrode member G5-4 and the sixth electrode G6 permeates the inside of the fourth electrode member G5-4 by a quantity approximately 1.5 times larger than the retraction quantity D of the inner electrode G5*a*.

Further, the guide electrode G5*b* of the fourth electrode member G5-4 includes three apertures which become guides at the time of assembling the electron gun. To consider the deformation of parts at the time of assembling the electron gun, it is necessary to set the thickness of the guide electrode G5*b* to not less than 0.5 mm. Accordingly, the electrode length L1 of the G5 top electrode G5-4 becomes 3.5×1.5+0.5=5.75 (mm) even at minimum.

In general, the smaller the gap between the electrodes of the electron gun, the electric field of the electric lens is further intensified. Accordingly, the smaller the gap of the curvature-of-image-field correction lens, the sensitivity is increased. However, when the electrodes become excessively close to each other, the withstand voltage between the electrodes becomes deteriorated and hence, the gap is usually set to 0.3 mm–1.0 mm.

Figure 4:
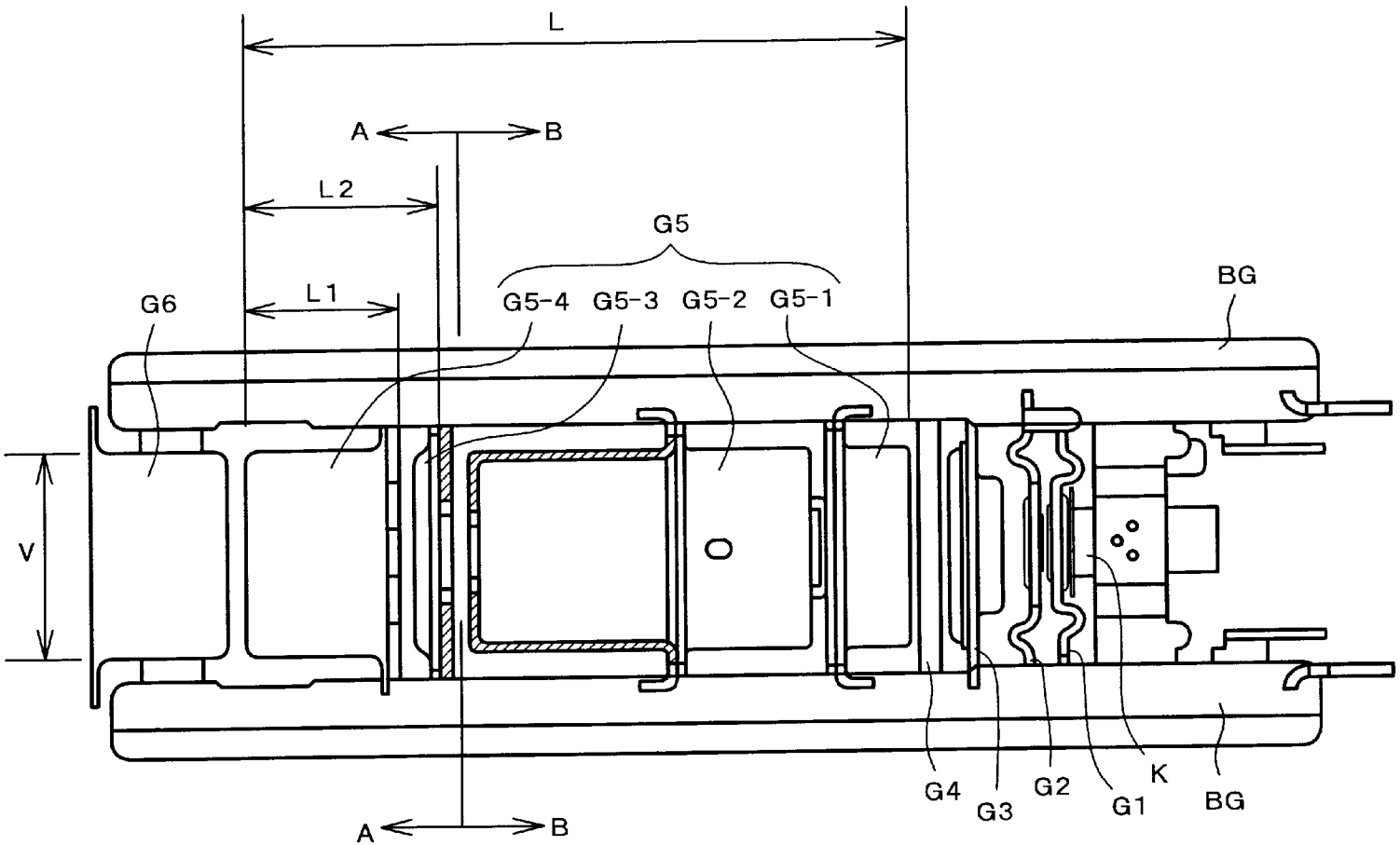
FIG. 4 is a side view with a part in cross section for explaining the constitution of a second embodiment of the electron gun used in a color cathode ray tube of the present invention.

FIG. 4 is a side view with a part in cross section for explaining the constitution of a second embodiment of an electron gun which is applied to a color cathode ray tube according to the present invention.

This electron gun includes an electron beam generating part which is comprised of a cathode K, a first electrode G1 which constitutes a control electrode and a second electrode G2 which constitutes an accelerating electrode, a prefocus lens which is comprised of the second electrode G2 and a third electrode G3, a front-stage main lens which is comprised of a third electrode G3, a fourth electrode G4 and a fifth electrode G5, and a rear-stage main lens (final-stage main lens) which is comprised of the fifth electrode G5 which constitutes a focus electrode and a sixth electrode G6 which constitutes an anode electrode.

These respective electrodes are embedded in a pair of beading glasses (multi-form glass) BG and are fixedly secured in a given arrangement. Although a so-called "a shield cap" is mounted on the distal end of the sixth electrode G6, such constitution is omitted from the drawing.

The fifth electrode G5 is divided into a first electrode member G5-1, a second electrode member G5-2, a third electrode member G5-3 and a fourth electrode member G5-4 (G5 top electrode).

The electrostatic quadrupole lenses are formed between the first electrode member G5-1 and the second electrode member G5-2 as well as between the second electrode member G5-2 and the third electrode member G5-3, while a curvature-of-image-field correction lens is formed between the third electrode member G5-3 and the fourth electrode member G5-4 which constitutes the G5 top electrode. Here, L indicates the total length (mm) of the fifth electrode G5.

Figure 5A:
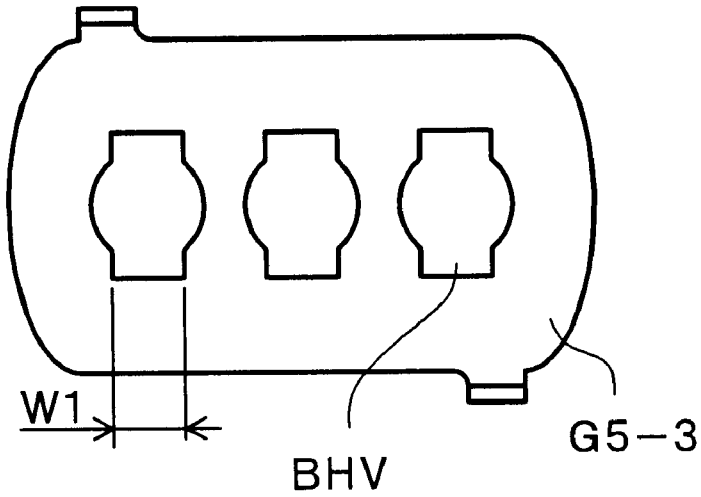
FIG. 5A and FIG. 5B are front views of electrodes constituting an electrostatic quadrupole lens in the electron gun shown in FIG. 4.
Figure 5B:
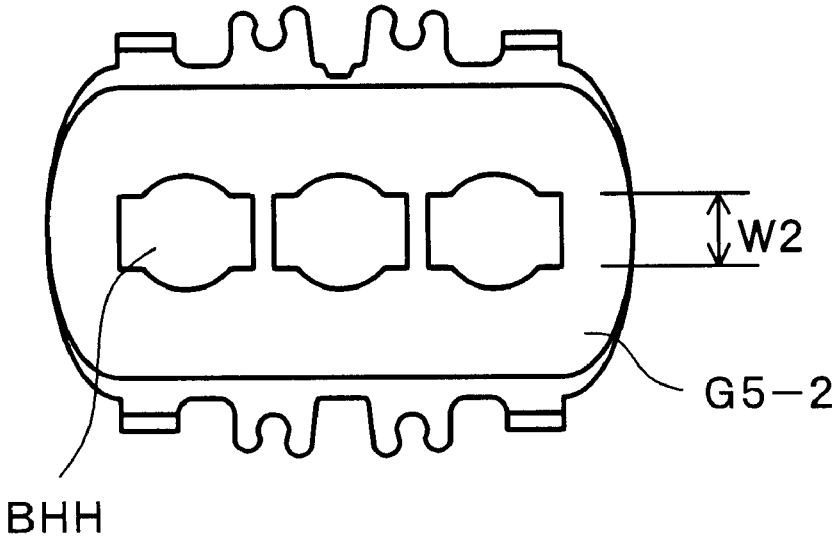

FIG. 5A and FIG. 5B are front views of the electrodes which constitute the electrostatic quadrupole lenses of the electron gun shown in FIG. 4. FIG. 5A is a front view which sees the third electrode member G5-3 of the fifth electrode G5 which forms the electrostatic quadrupole lens in the direction of an arrow A—A in FIG. 4 and FIG. 5B is a front view which sees the second electrode member G5-2 of the fifth electrode G5 which forms the electrostatic quadrupole lens in the direction of an arrow B—B in FIG. 4.

The beam generating part which generates a plurality of (three in this embodiment) of electron beams is constituted by the cathode K, the control electrode (first electrode) G1 and the acceleration electrode (second electrode) G2. By passing through the front-stage main lens which is constituted by the third electrode G3, the fourth electrode G4 and the neighboring first electrode member G5-1 of the fifth electrode and the fifth electrode G5 constituted by the first electrode member G5-1 to G5 top electrode G5-4, electron beams generated by the beam generating part receive the focusing action and the astigmatism correction action. The electron beams which are focused in the front stage is further focused and accelerated by the final-stage main lens formed in an opposing gap defined between the G5 top electrode G5-4 of the fifth electrode G5 and the sixth electrode G6 and then are impinged on the phosphor screen.

The first electrostatic quadrupole lens is formed between the first electrode member G5-1 and the second electrode member G5-2 of the fifth electrode G5. Further, the second electrostatic quadrupole lens is formed between the second electrode member G5-2 and the third electrode member G5-3 of the fifth electrode G5.

Further, the curvature-of-image-field correction lens is formed between the third electrode member G5-3 and the G5 top electrode G5-4.

Then, the fourth electrode member G5-4 of the fifth electrode G5 which forms the final-stage main lens is constituted by a cup-shaped electrode, wherein when the vertical-direction diameter of an aperture of the cup-shaped electrode which faces the sixth electrode G6 in an opposed manner is set to V (mm) and the total length in the tube axis direction of the fifth electrode G5 is set to L (mm), the relationship between V and L is set as follows as in the case of the first embodiment.

$$31 \leqq L \leqq 4.7V - 9.3 \leqq 43$$

Further, the sixth electrode G6 which forms the main lens is also formed of a cup-shaped electrode and it is usual that the vertical direction diameter of the aperture which faces the fourth electrode member G5-4 of the cup-shaped electrode is also set to V (mm) as in the case of the fourth electrode member G5-4 of the fifth electrode G5.

With respect to the above-mentioned fifth electrode G5 which constitutes the focus lens, electron beam passing apertures BHV of a key-hole shape having a long axis in the vertical direction are formed in a surface of the third electrode member G5-3 which constitutes one electrode forming the second electrostatic quadrupole lens and faces the second electrode member G5-2 in an opposed manner. Further, electron beam passing apertures BHH of a key-hole shape having a long axis in the horizontal direction are formed in a surface of the second electrode member G5-2 which constitutes the other electrode forming the electrostatic quadrupole lens and faces the third electrode member G5-3 in an opposed manner.

Then, an electrostatic quadrupole lens is formed in an opposing gap between the above-mentioned electron beam passing apertures BHV and BHH having a key-hole shape. Assuming the distance from the surface of the focus electrode G5 which faces the anode G6 to an end portion of the electrostatic quadrupole lens at the final-stage main lens side as L2, a following relationship is set with respect to L2 in the same manner as the first embodiment.

$$7.55 \leqq L2 \leqq 11.5$$

Figure 6:
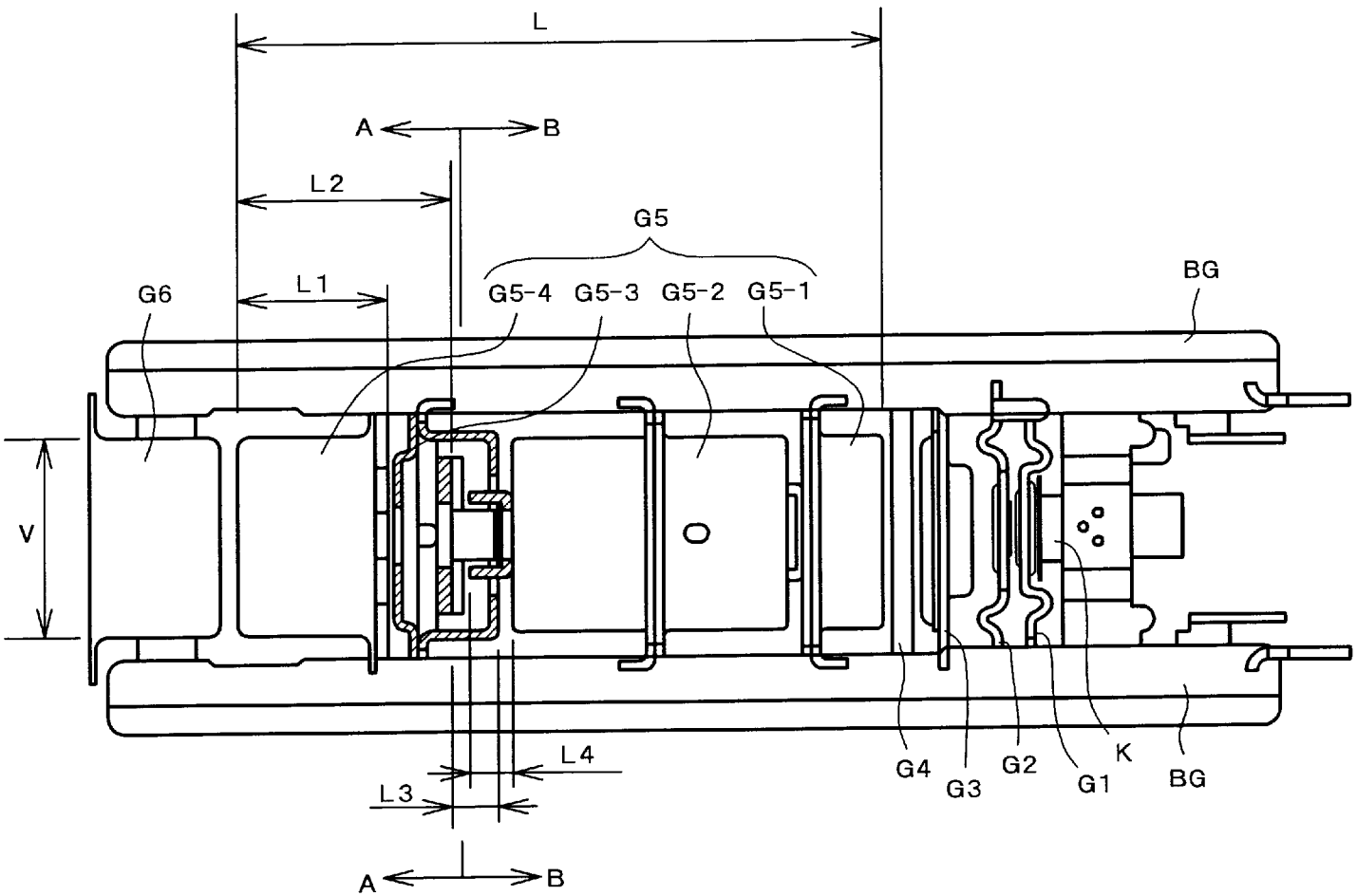
FIG. 6 is a side view with a part in cross section explaining the constitution of a third embodiment of the electron gun used in the color cathode ray tube of the present invention.

FIG. 6 is a side view with a part in cross section for explaining the constitution of a third embodiment of an electron gun which is applied to a color cathode ray tube according to the present invention. This electron gun also includes an electron beam generating part which is comprised of a cathode K, a first electrode G1 which constitutes a control electrode and a second electrode G2 which constitutes an accelerating electrode, a prefocus lens which is comprised of the second electrode G2 and a third electrode G3, a front-stage main lens which is comprised of a third electrode G3, a fourth electrode G4 and a fifth electrode G5, and a rear-stage main lens (final-stage main lens) which is comprised of the fifth electrode G5 which constitutes a focus electrode and a sixth electrode G6 which constitutes an anode.

These respective electrodes are embedded in a pair of beading glasses (multi-form glass) BG and are fixedly secured in a given arrangement. Although a so-called "a shield cap" is mounted on the distal end of the sixth electrode G6, such constitution is omitted from the drawing.

The fifth electrode G5 is divided into a first electrode member G5-1, a second electrode member G5-2, a third electrode member G5-3 and a fourth electrode member G5-4 (G5 top electrode).

The electrostatic quadrupole lenses are formed between the first electrode member G5-1 and the second electrode member G5-2 as well as between the second electrode member G5-2 and the third electrode member G5-3, while a curvature-of-image-field correction lens is formed between the third electrode member G5-3 and the fourth electrode member G5-4 which constitutes the G5 top electrode. Here, L indicates the total length (mm) of the fifth electrode G5.

Figure 7A:
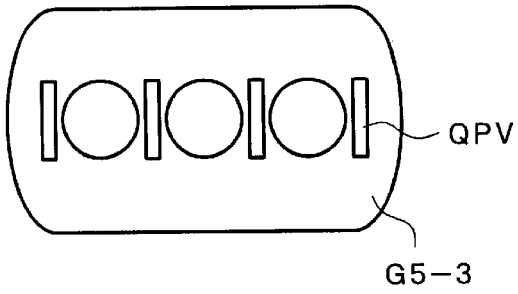
FIG. 7A and FIG. 7B are front views of a third electrode member and a second electrode member of a fifth electrode which constitutes a second electrostatic quadrupole lens shown in FIG. 6.
Figure 7B:
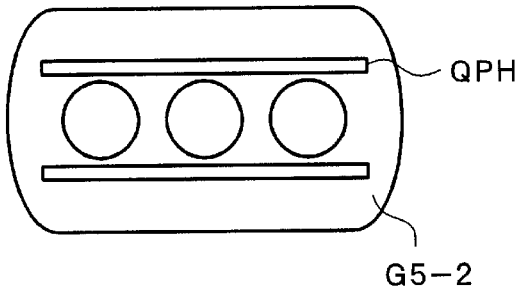
Figure 8:
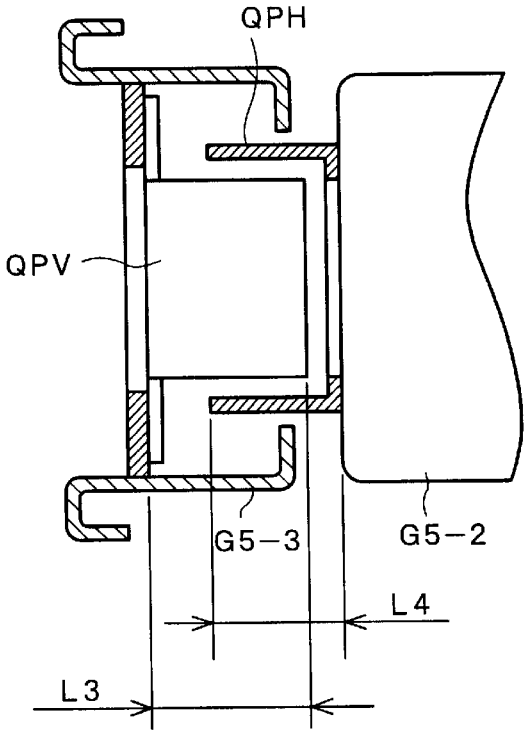
FIG. 8 is an explanatory view of an electrode structure which forms an electrostatic quadrupole lens at opposing portions of the third electrode member and the second electrode member shown in FIG. 7.

FIG. 7A and FIG. 7B are front views of the third electrode member G5-3 and the second electrode member G5-2 of the fifth electrode G5 which constitute the second electrostatic quadrupole lens shown in FIG. 6. FIG. 7A is a front view of the third electrode member G5-3 as seen in the direction of an arrow A—A in FIG. 6 and FIG. 7B is a front view of the second electrode member G5-2 as seen in the direction of an arrow B—B in FIG. 6. Further, FIG. 8 is an explanatory view of the electrode structure which forms the electrostatic quadrupole lens in an opposing portion between the third electrode member G5-3 and the second electrode member G5-2 shown in FIG. 7.

With respect to the electrode constituting the above-mentioned focus lens, in the inside of the third electrode member G5-3 which constitutes one electrode forming the second electrostatic quadrupole lens, a plurality of vertical correction electrode plates QPV which respectively sandwich a plurality of electron beams from the horizontal direction and are protruded in the tube axis direction toward the cathode K are provided (see FIG. 7A).

Further, on a surface of the second electrode member G5-2 which constitutes the other electrode and faces the third electrode member G5-3, a pair of horizontal correction electrode plates QPH are formed such that the electrode plates sandwich a plurality of respective electron beams from the vertical direction, the electrode plates are protruded along the tube axis direction toward the third electrode member G5-3 which constitutes one electrode member, and the electrode plates sandwich the vertical correction electrode plates QPV from the vertical direction to be superposed with the vertical correction electrode plates QTV (see FIG. 7B). FIG. 8 shows this state. The type which combines the vertical correction electrode plate QPV and a pair of horizontal correction electrode plates QPH as shown in FIG. 8 is called a superposition type electrostatic quadrupole lens.

Then, assuming the electrode length in the tube axis direction of the vertical correction electrode plates QPV as L3 and the electrode length in the tube axis direction of the horizontal correction electrode plate QPH as L4, a following relationship is set with respect to L3+L4. The calculation basis of this relationship equation will be explained later.

$$2.18 \leqq (L3+L4)/2 \leqq 2.78$$

Figure 9:
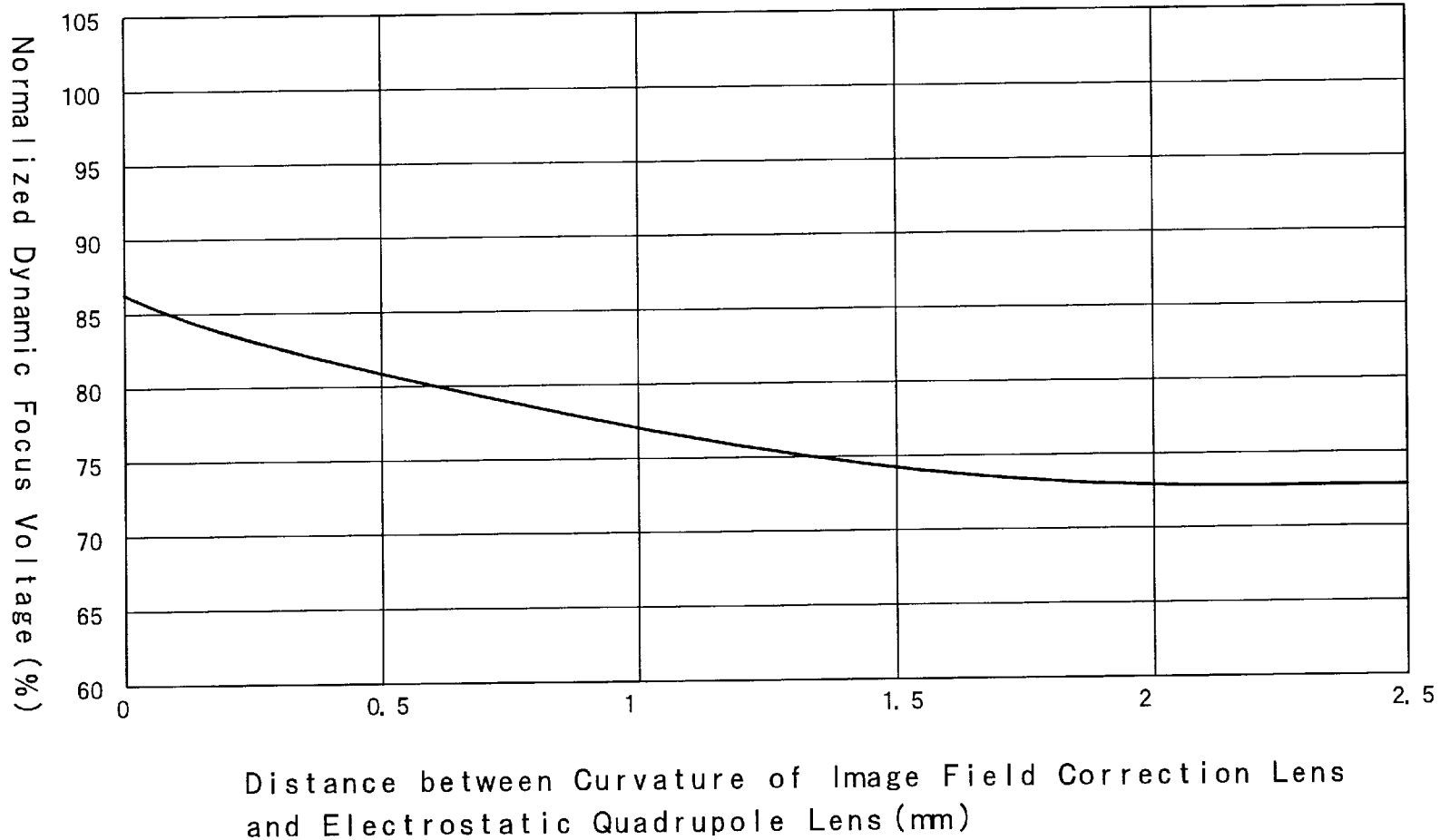
FIG. 9 is an explanatory view of a result obtained by analyzing an influence which the distance between a curvature-of-image-field correction lens and the electrostatic quadrupole lens gives to a dynamic focus voltage (DF voltage).

FIG. 9 is an explanatory view of a result obtained by analyzing an influence which the distance between a curvature-of-image-field correction lens and the electrostatic quadrupole lens gives to a dynamic focus voltage (DF voltage) in a multi-stage dynamic focusing (MDF) system electron gun. The DF voltage is expressed by a normalized percent with an analysis value in an electron gun of a non-multi-stage dynamic focusing system.

As shown in FIG. 9, the distance between the curvature-of-image-field correction lens and the electrostatic quadrupole lens is excessively small, the DF voltage is increased. Since the DF voltage is applied in synchronism with the horizontal deflection, when the voltage is high, it becomes difficult to cope with the high-speed deflection. Accordingly, it is preferable that the DF voltage is low.

To set the DF voltage to the minimum value, it is necessary to set the distance between the curvature-in-image-field correction lens and the electrostatic quadrupole lens to not less than 1.5 mm.

In FIG. 9, to ensure the distance between the curvature-in-field correction lens and the electrostatic quadrupole lens necessary for decreasing the DF voltage, it is effective for shortening the total length of the focus electrode to arrange the curvature-of-image-field correction lens such that the curvature-of-image-field correction lens is arranged closest to the final-stage main lens side.

In view of the respective shortest dimensions 5.75 mm, 0.3 mm and 1.5 mm of the electrode length L1 of the fourth electrode member G5-4, the gap of the curvature-of-image-field correction lens formed between of the fourth electrode member G5-4 and the third electrode member G5-3 and the distance from the end portion of the curvature-of-image-field correction lens at the cathode K side to the end portion of the electrostatic quadrupole lens formed between the third electrode member G5-3 and the second electrode member G5-2 at the sixth electrode G6 side, it is necessary to set the distance L1 from the surface of the G5-4 which faces the sixth electrode G6 in an opposed member to the end portion of the electrostatic quadrupole lens at the sixth electrode G6 side to not less than 7.55 mm.

Figure 10:
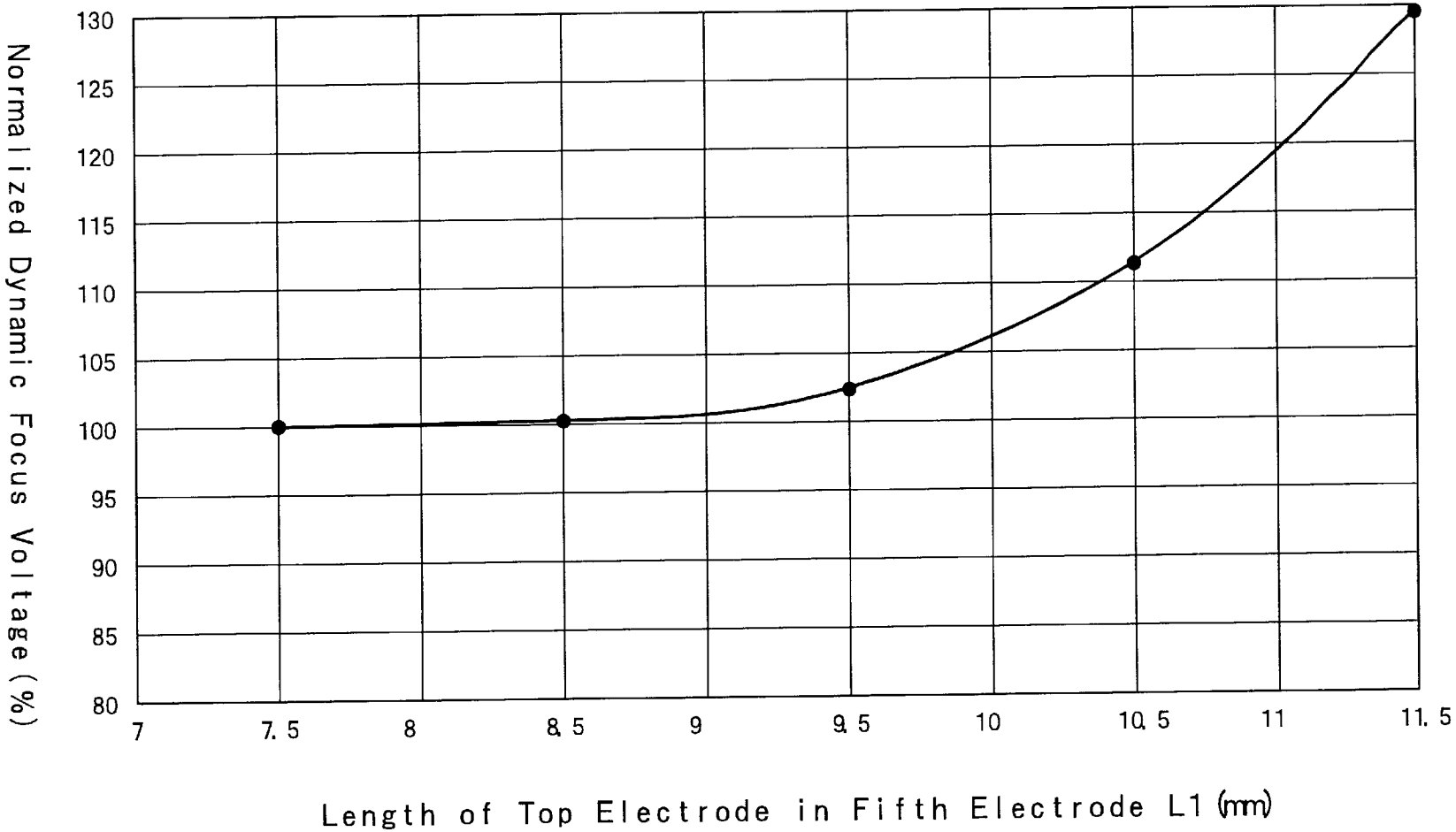
FIG. 10 is an explanatory view of a result obtained by analyzing the change of a dynamic focus voltage to the length of a top electrode of the fifth electrode when the electron gun shown in FIG. 1 is applied to a color cathode ray tube having a screen diagonal effective diameter of 51 cm.

FIG. 10 is an explanatory view of a result obtained by analyzing the change of the dynamic focus voltage to the electrode length of the top electrode G5-4 of the fifth electrode G5 when the electron gun shown in FIG. 1 is applied to a color cathode ray tube having an effective diameter in the screen diagonal direction of 51 cm. The dynamic focus voltage (DF voltage) is normalized with a value when the electrode length L1 of the top electrode G5-4 of the fifth electrode G5 is set to 7.5 mm.

As shown in FIG. 10, when the electrode length L1 of the top electrode G5-4 of the fifth electrode G5 exceeds 9.5 mm, the dynamic focus voltage (DF voltage) is sharply increased. To effectively use the flyback transformer for general use by lowering the focus voltage, it is preferable to set the electrode length L1 of the fourth electrode member G5-4 of the fifth electrode G5 to not more than 9.5 mm.

Figure 11:
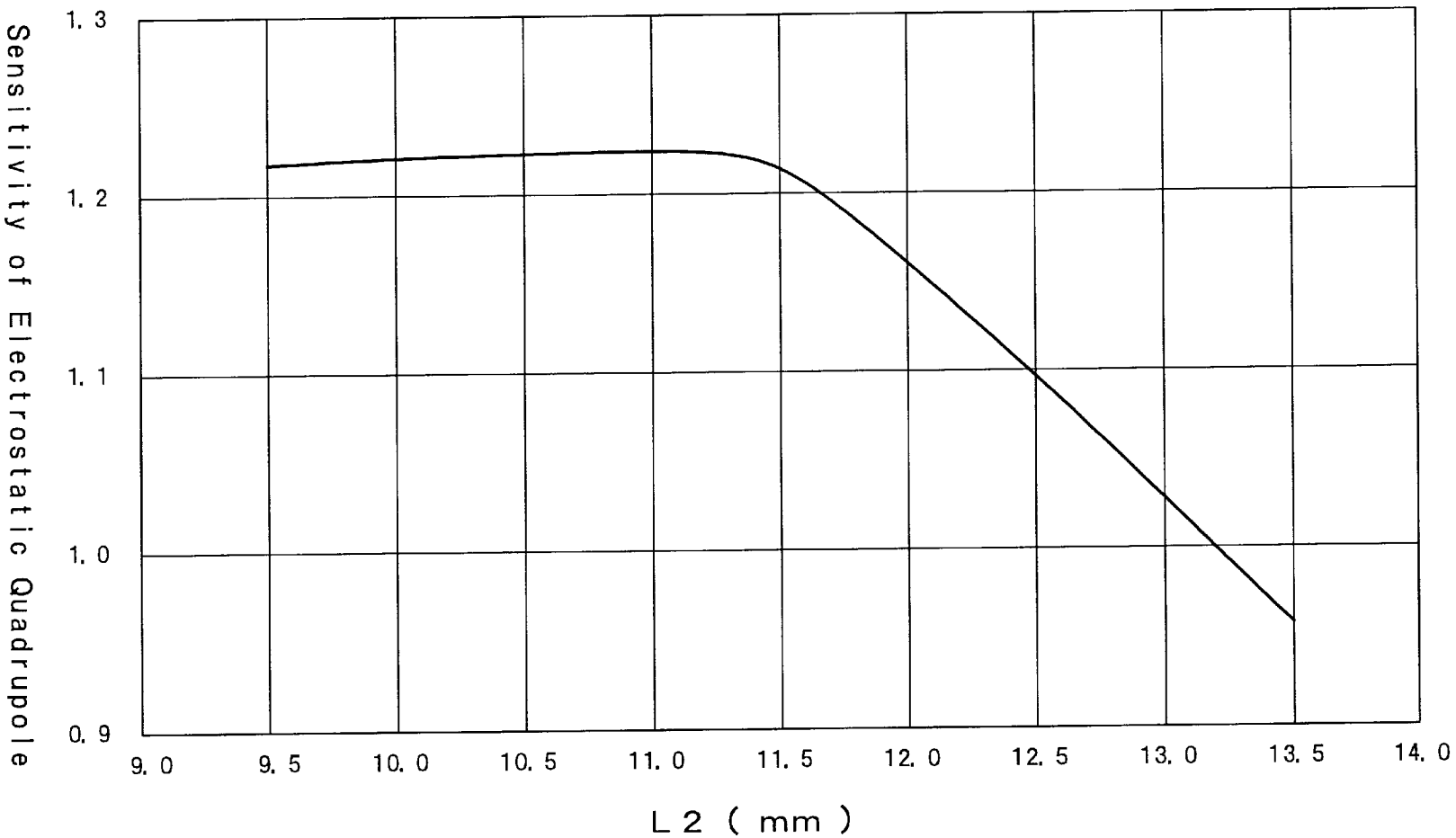
FIG. 11 is an explanatory view of a result obtained by analyzing the relationship between the distance L2 from a surface of the top electrode of the fifth electrode which faces a sixth electrode in an opposed manner to a sixth electrode side position of the electrostatic quadrupole lens and the sensitivity of the electrostatic quadrupole lens.

FIG. 11 is an explanatory view of a result obtained by analyzing the relationship between the length L2 from the surface of the G5 top electrode G5-4 which faces the sixth electrode G6 to the position of the electrostatic quadrupole lens at the sixth electrode G6 side and the sensitivity of the electrostatic quadrupole lens. As can be understood from FIG. 11, the sensitivity of the electrostatic quadrupole lens is sharply deteriorated when L2 exceeds 11.5 mm. Here, the sensitivity means a beam deformation rate in the main lens when the DF voltage of 500 V is applied to the main lens compared to when the DF voltage of 0 volt is applied to the main lens. The beam deformation rate is a rate of longitudinal diameter to the lateral diameter. When L2 exceeds 11.5 mm, even if the DF voltage of 500 V is applied to the main lens, the action to focus the beam lateral diameter and/or the action to divert the beam longitudinal diameter are/is deteriorated.

To increase the sensitivity of the electrostatic quadrupole lens, there exist techniques which structurally intensify such sensitivity such as the elongation of the electrostatic quadrupole lens portion and the provision of a plurality of electrostatic quadrupole lens portion or the like. However, the strong electrostatic quadrupole lens may cancel the astigmatism generated by the deflection magnetic field, as well as, it deforms largely the cross-sectional shape of the beams and hence, there may be a case that the strong electrostatic quadrupole lens deteriorates the focusing to the contrary. To increase the sensitivity of the electrostatic quadrupole lens without using the techniques which structurally intensify the sensitivity, it is necessary to set the above-mentioned L2 to not more than 11.5 mm.

Figure 12:
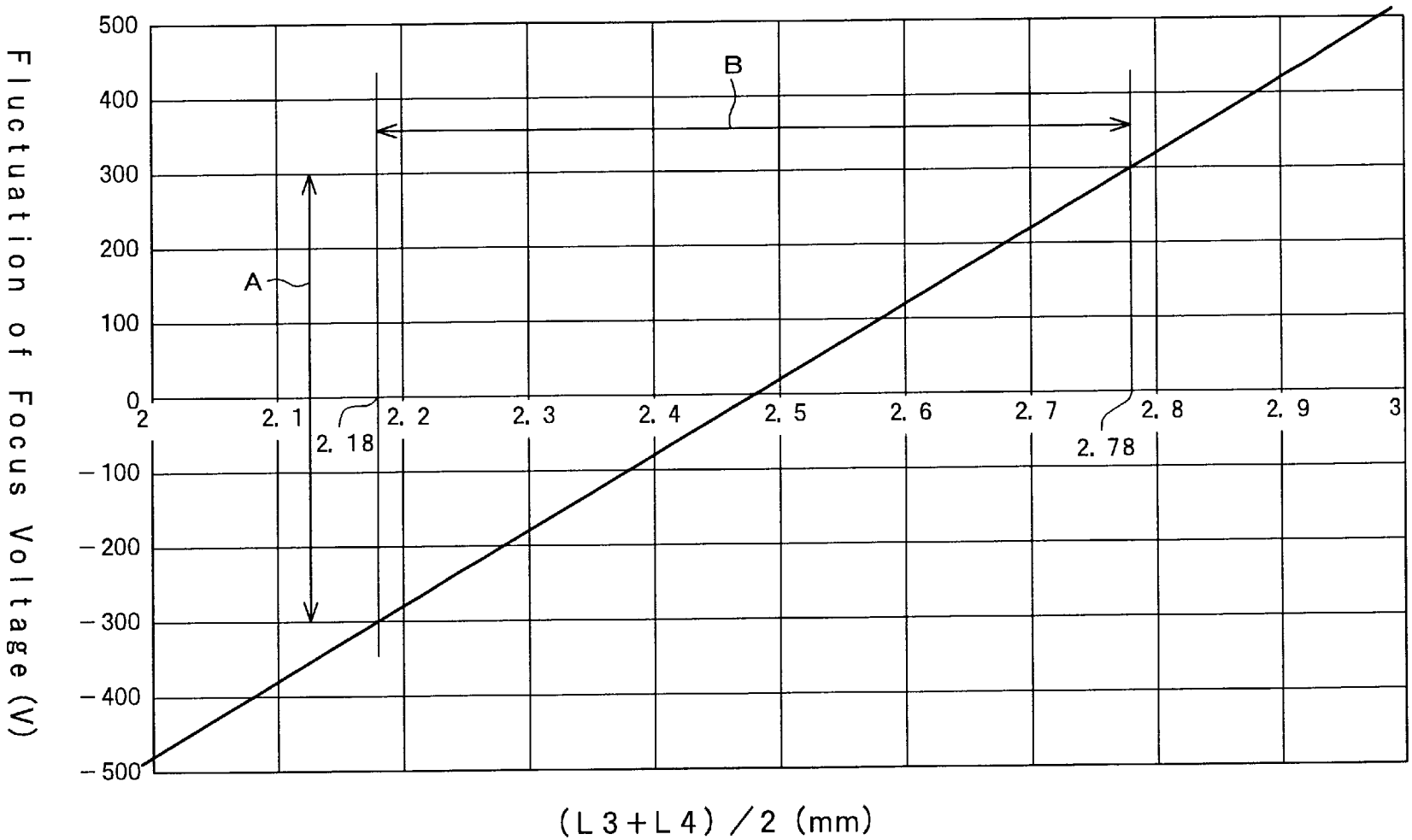
FIG. 12 is an explanatory view of a result obtained by analyzing a focus voltage fluctuation quantity when the electrostatic quadrupole lens of a superposition type is adopted.

Subsequently, the optimization of the electrostatic quadrupole lens is explained. FIG. 12 is an explanatory view of a result obtained by analyzing a fluctuation quantity of the focus voltage when a superposition type electrostatic quadrupole lens is adopted. In the drawing, the result which is obtained by analyzing a value produced by subtracting a just focus voltage on a longitudinal line at the screen central portion of the screen from a just focus voltage on a longitudinal line at the screen corner portion when the DF voltage is optimized such that the lateral line which passes the screen center becomes the optimal focus Oust focus) state using (L3+L4)/2 as a parameter is shown.

When the difference of longitudinal-line just focus voltage is excessively large in "+" direction, the focusing in the peripheries of the screen is deteriorated and an overfocus state (halo) is generated on the longitudinal line, while when the difference of longitudinal-line just focus voltage is excessively large in "−" direction, the focusing in the peripheries of the screen is deteriorated and an underfocus state (blooming) is generated on the longitudinal line. When the difference of longitudinal-line just focus voltage exceeds ±300 V, the focus deteriorated state becomes apparent and the quality of displayed image as a color cathode ray tube is remarkably degraded. Accordingly, it is necessary to set this difference of longitudinal-line just focus voltage within a range of ±300 V as indicated by "A" in FIG. 12.

As a result, the range of (L3+L4)/2 becomes a following range as indicated by "B" in FIG. 12.

$$2.18 \leqq (L3+L4)/2 \leqq 2.78$$

Subsequently, a case in which the electrostatic quadrupole lens of a type which inserts protruding ends of the horizontal correction electrode plates into one electron beam passing apertures having a key-hole shape shown in FIG. 1 is explained.

Figure 13:
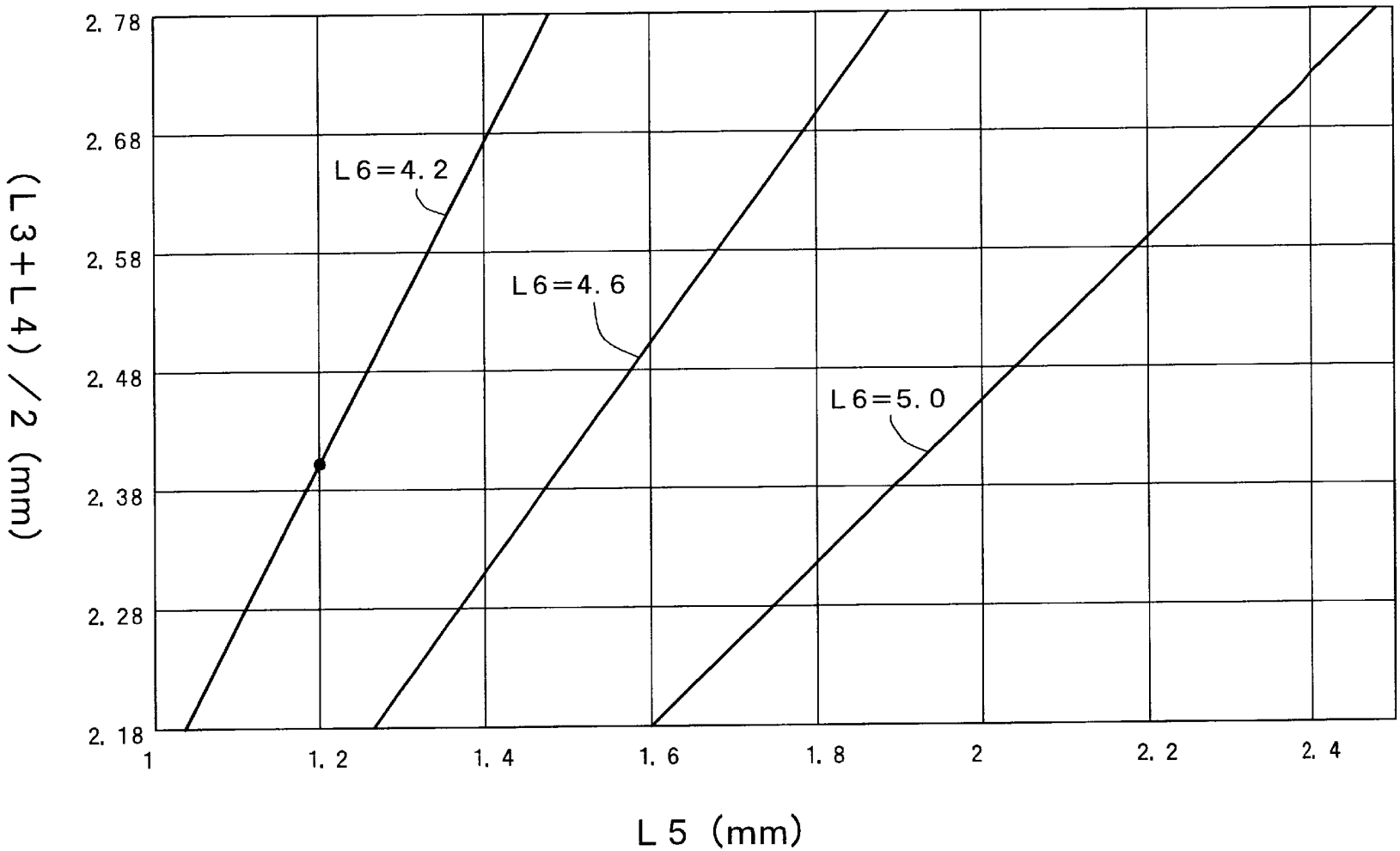
FIG. 13 is an explanatory view showing a value of (L3+L4)/2 which is obtained by setting the distance L6 in the vertical direction of horizontal correction plates of the electrostatic quadrupole lens shown in FIG. 2 as a parameter, changing the length L5 in the tube axis direction of the horizontal correction plate and converting this length L5 into the superposed-type electrostatic quadrupole lens which is operated with the same sensitivity.

FIG. 13 is an explanatory view showing the value of (L3+L4)/2 which is obtained by changing the length L5 in the tube axis direction of the horizontal correction plates QPH while using the vertical direction distance L6 of the horizontal correction plates QPH of the electrostatic quadrupole lens shown in FIG. 2 as a parameter and converting the length L5 into (L3+L4)/2 which is the value of the superposition type electrostatic quadrupole lens which is operated with the same sensitivity.

Although the operation of the electrostatic quadrupole lens is proportional to the length L5 in the tube axis direction of the horizontal correction plates QPH, the operation becomes weakened in a curved form depending on the vertical direction distance L6. Further, the larger the distance L6 in the vertical direction, the lowering of the sensitivity becomes greater.

Figure 14:
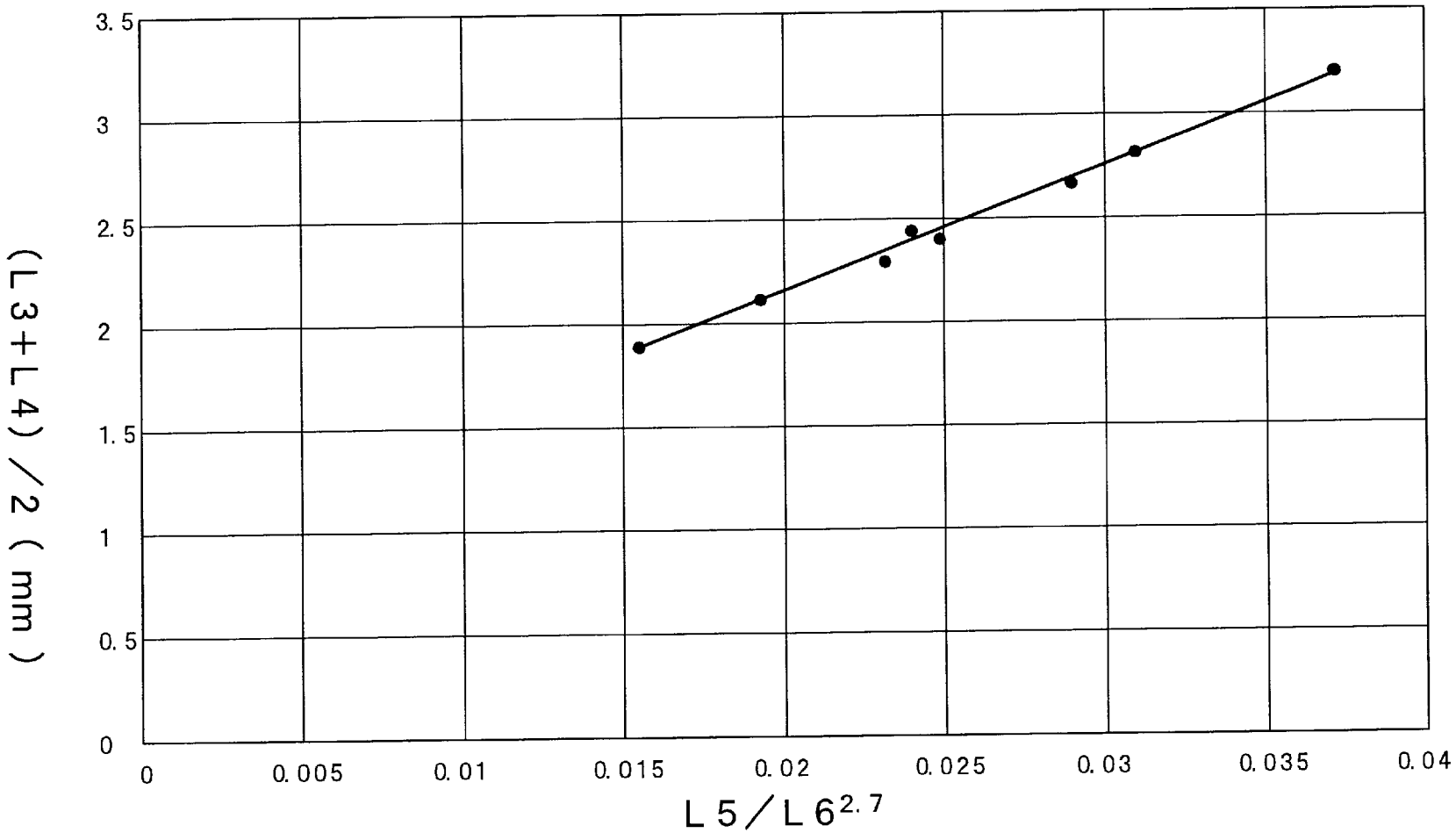
FIG. 14 is an explanatory view showing the correspondence between $L5/L6^n$ when the value of n is obtained such that the correlation coefficient becomes maximum and (L3+L4)/2 which is operated with the same sensitivity.
Figure 15:
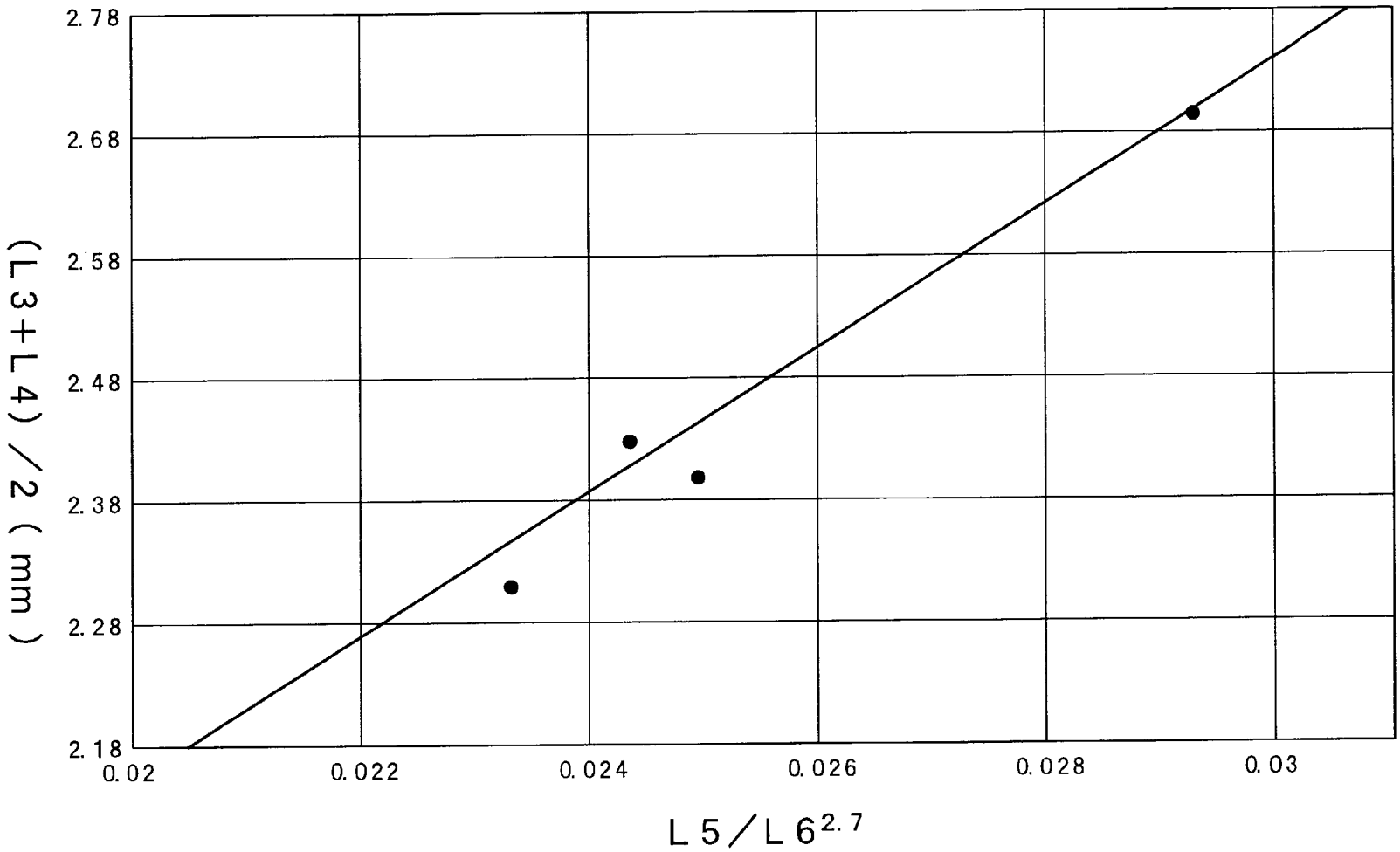
FIG. 15 is an enlarged view of FIG. 14.

From the above facts, assuming that the sensitivity is proportional to L5/L6 , to obtain the value of "n" which makes the correlation coefficient maximum, n becomes n=2.7. FIG. 14 shows the correspondence between the $L5/L6^n$ and (L3+L4)/2 of the superposition type electrostatic quadrupole lens structure which is operated with the same sensitivity. FIG. 15 is an enlarged view of FIG. 14.

Here, the value of $L5/L6^{2.7}$ in the range of (L3+L4)/2 in the superposition type electrostatic quadrupole lens structure indicated by "B" in FIG. 12 is set as follows.

$$0.0206 \leqq (L5/L6^{2.7}) \leqq 0.0306$$

Figure 16:
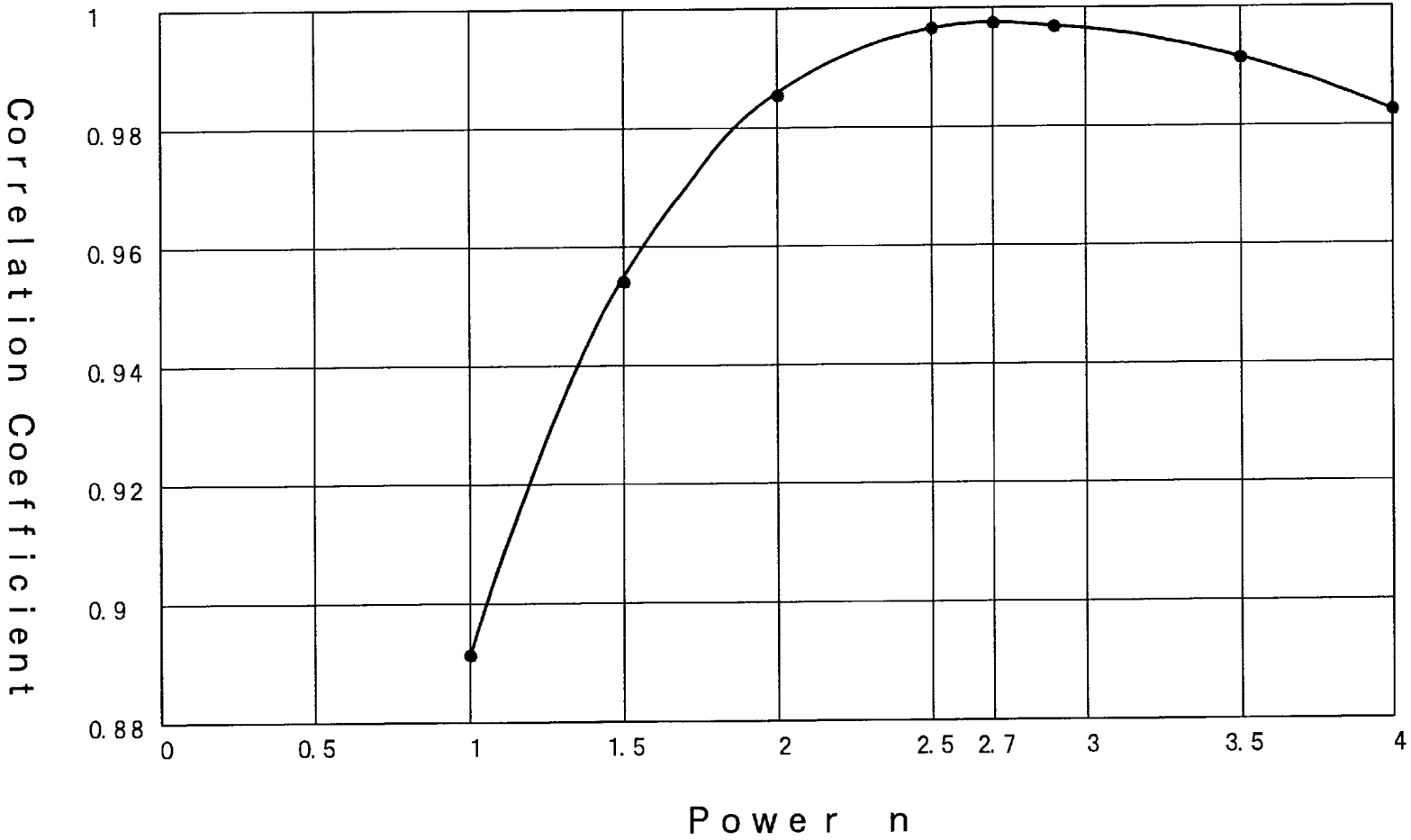
FIG. 16 is an explanatory view of the relationship between the degree obtained as a value of n of $L5/L6^n$ and the correlation coefficient.

FIG. 16 is an explanatory view of the relationship between the degree obtained as the value of n in $L5/L6^n$ and the correlation coefficient. Corresponding to the increase of the degree n from 1, the correlation coefficient gradually approaches 1 and when the n is set to 2.7, the correlation coefficient approaches closest to 1. Corresponding to the further increase of the degree n thereafter, the correlation coefficient is decreased. The correlation coefficient when the degree n is set to n=2.7 is 0.9969 and is approximated to a substantially straight line in the graph shown in FIG. 14.

Further, in the electrostatic quadrupole lens shown in FIG. 4 and FIG. 5 where the electron beam passing apertures of a key-hole type are made to face each other in an opposed manner, the distance between two opposing electrodes is set to not more than 1.0 mm. In this case, the correspondence when the dimension (W1+W2)/2 of the key hole of FIG. 5 is replaced with the dimension (L3+L4)/2 of the horizontal correction electrode plate and the vertical correction electrode plate of the superposition type electrostatic quadrupole lens having the same sensitivity is analyzed. As the result, (W1+W2)/2 in the range of (L3+L4)/2 of the superposition type electrostatic quadrupole lens indicated by "B" in FIG. 12 becomes a following value.

$$2.00 \leqq (W1+W2)/2 \leqq 3.60$$

Figure 17:
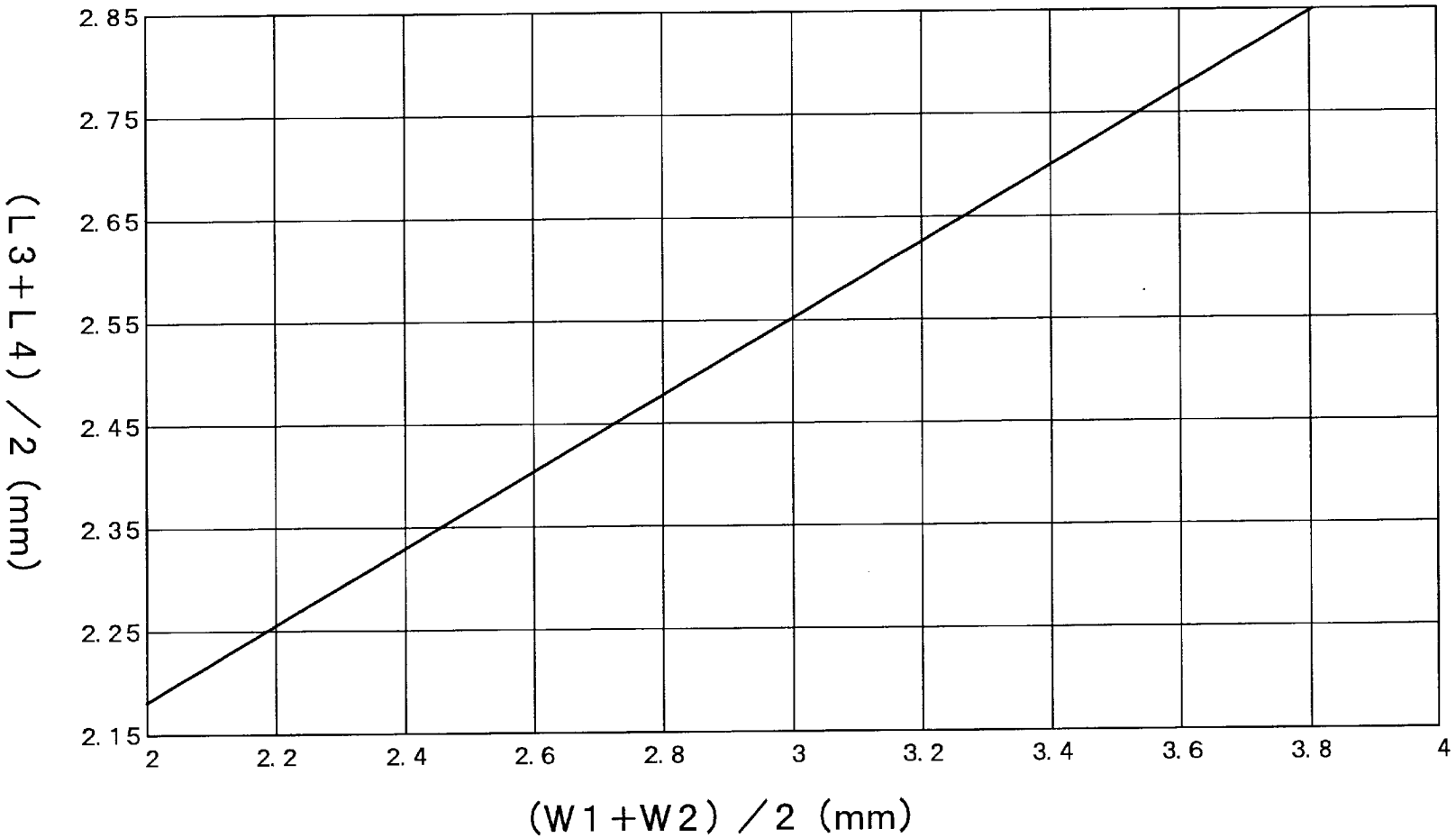
FIG. 17 is an explanatory view of a result obtained by analyzing the correspondence between the dimension of a key hole in the electrostatic quadrupole lens which is made to face a key-hole type electron beam passing aperture in an opposed manner and the dimensions of the horizontal correction electrode plates and the vertical correction electrode plates of the superposed type electrostatic quadrupole lens.

The result of analysis is shown in FIG. 17.

To give some specific numerical values with respect to the electron gun of the above-mentioned embodiment, they are as follows. Assuming the electrode length L1 of the G5 top electrode G5-4 as 7.5 mm, (1) in case of the superposition type electrostatic quadrupole lens, L2=10.7 mm, L3=3.0 mm, L4=2.1 mm, (L3+L4)/2=2.55 mm.

(2) in case of the key-hole type electrostatic quadrupole lens, L2=9.0 mm, W1=W2=(W1+W2)/2=3.0 mm.

The above is only an example. With respect to an electron gun which is actually used as a product, the vertical directional diameter V of the main lens electrode is set to 10 mm and the electrode length L of the fifth electrode G5 is set to 32.5 mm–33.5 mm.

With the provision of the electron gun having the above-mentioned constitution, a flat-panel type color cathode ray tube having an effective screen diagonal diameter of 51 cm can be realized on a television picture tube or a monitor which uses a flyback transformer for general use.

Figure 18:
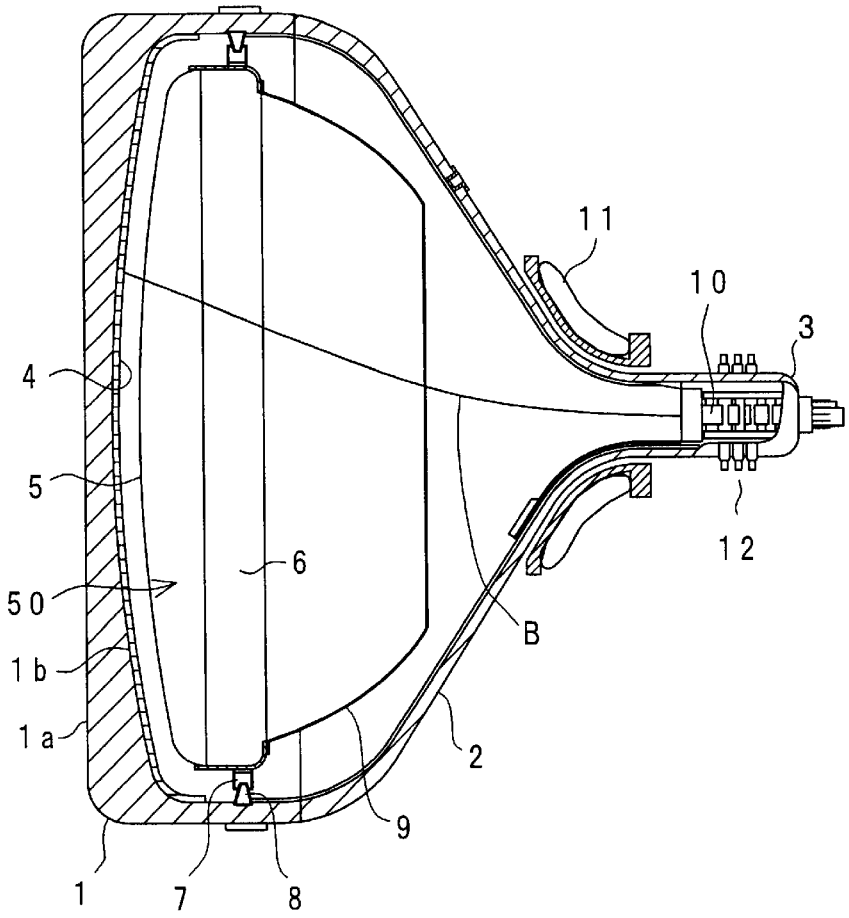
FIG. 18 is a schematic cross-sectional view for explaining the entire constitution of the color cathode ray tube according to the present invention.
Figure 19:
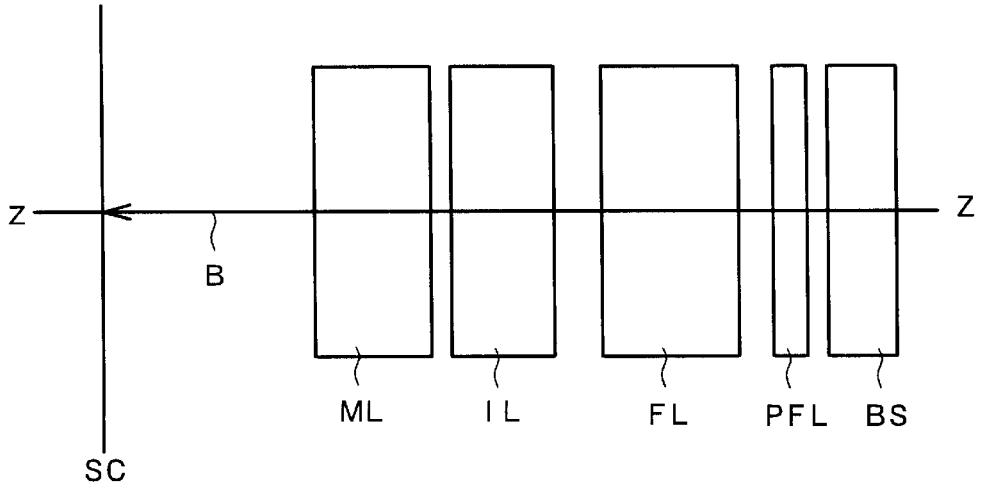
FIG. 19 is a schematic view for explaining a general lens constitution of an electron gun which is applied to the color cathode ray tube of the present invention.
Figure 20:
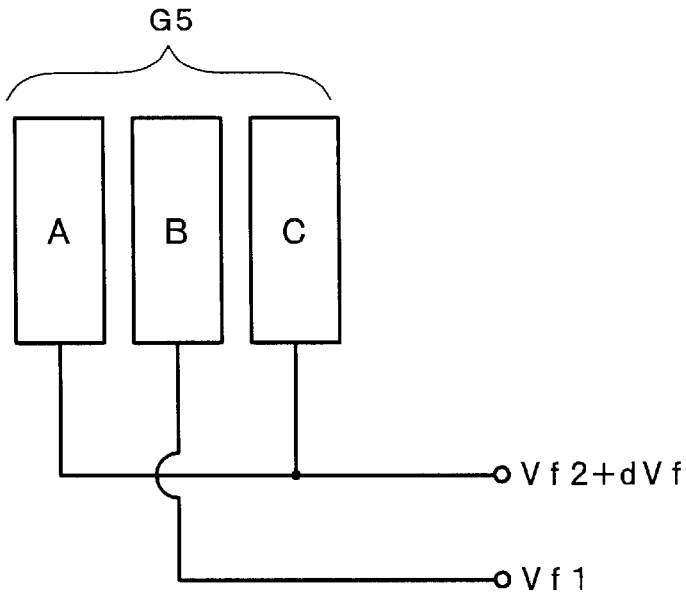
FIG. 20 is an explanatory view of a focus voltage applied to a focus electrode which is divided into a plurality of electrode members.
Figure 21:
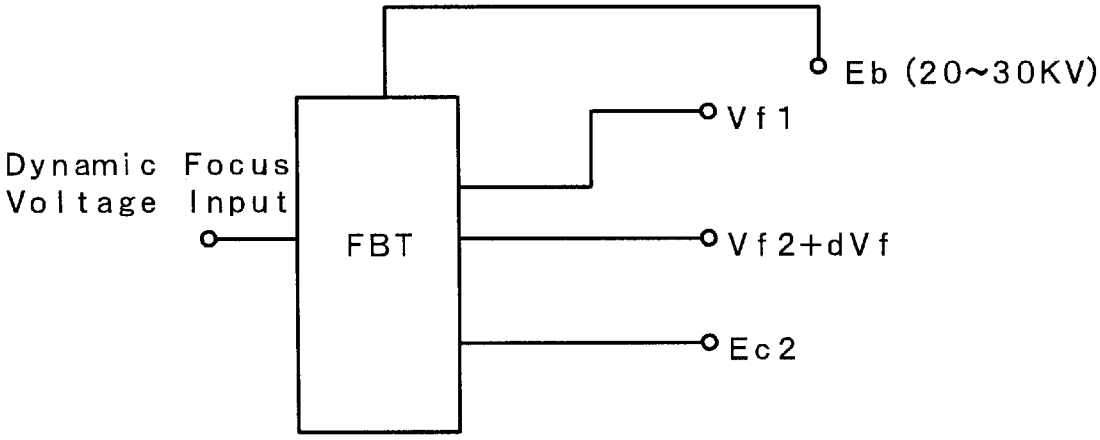
FIG. 21 is an explanatory view of an output voltage of a flyback transformer which generates two focus voltages.
Figure 22:
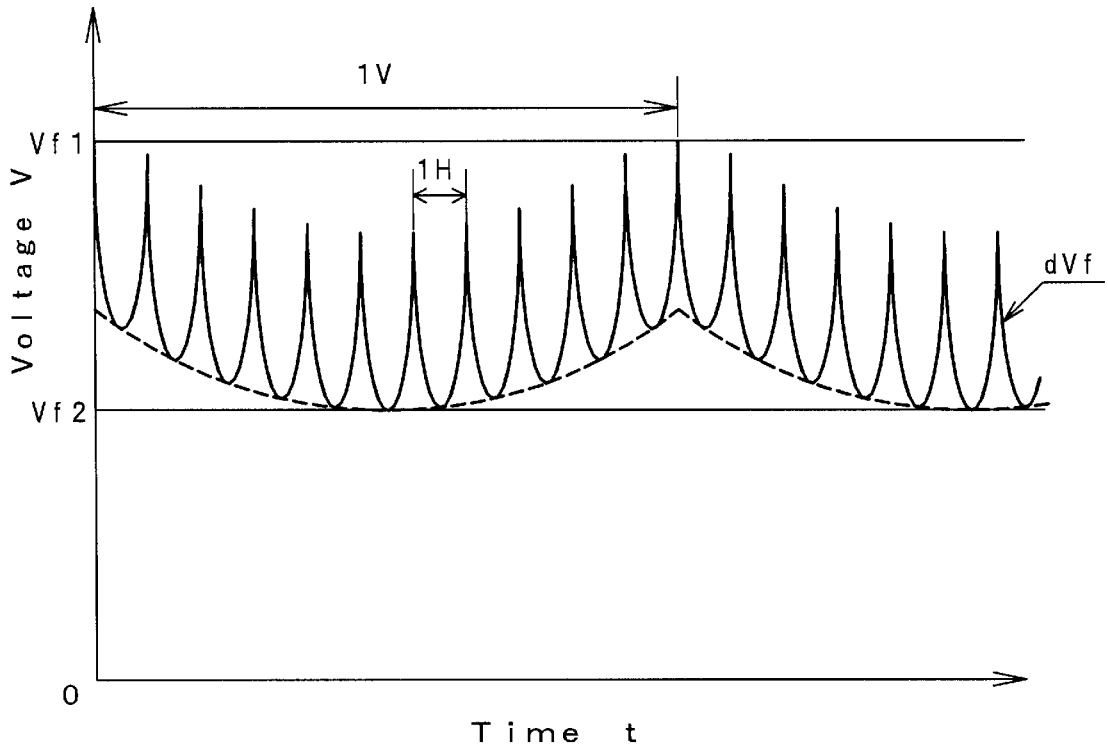
FIG. 22 is an explanatory view of focus voltages applied to the electrode members of the divided focus electrode.

FIG. 18 is a schematic cross-sectional view for explaining the entire constitution of the color cathode ray tube according to the present invention. This color cathode ray tube is a flat-panel type color cathode ray tube in which an outer surface 1*a* of a panel 1 has an equivalent radius of curvature considerably larger than that of an inner surface 1*b* of the panel 1. The outer surface 1 a of the panel 1 has average radii of curvature of not less than 10000 mm along a long axis, a short axis and a diagonal axis on an effective screen area and hence, the outer surface 1*a* of the panel 1 appears approximately flat. On the other hand, the inner surface 1*b* of the panel 1 has average radii of curvature of not more than 6000 mm along the long axis, the short axis and the diagonal axis on the effective screen area and hence, the inner surface 1*b* of the panel 1 is considerably curved compared with the outer surface 1*a*. This is because that the color cathode ray tube adopts a shadow mask 5 of a press mask system which can be fabricated at a low cost and easily. This shadow mask 5 of the premask system has a curved shape which is also considerably curved along a long axis, a short axis and a diagonal line on an apertures area as in the case of the shape of the inner surface 1*b* of the panel 1.

A tri-color phosphor is coated on the inner surface 1*b* of the panel 1 to form a screen 4. A shadow mask structural body 50 is installed at a position close to the phosphor screen 4. The shadow mask structural body 50 is, for example, formed by welding a shadow mask 5 formed by pressing Invar material having a thickness of 0.13 mm to a mask frame 6 made of iron-based metal having a thickness of 1.1 mm. A suspension mechanism 7 having spring members is mounted on a side surface of the mask frame 6 and the shadow mask structural body 50 is suspended in a given place by engaging the suspension mechanism 7 with stud pins 8 which are embedded in an inner side wall of the panel 1.

The panel 1 is adhered to a large-diameter opening of a funnel 2 having a funnel-shape and a small diameter side of the funnel 2 is connected to a neck 3. An electron gun 10 which emits three electron beams B is accommodated in the inside of the neck portion 3. This electron gun 10 is the electron gun which has been explained in the previous embodiment.

An external magnet device 12 for performing the color purity correction and the like is mounted around the neck 3. Then, a deflection yoke 11 is externally mounted on a transition area of the funnel 2 and the neck 3 (neck side of the funnel) and deflects three electron beams B in two directions, that is, the horizontal direction and the vertical direction to reproduce a two-dimensional image on the screen 4. A magnetism shield 9 which shields electron beams B from an external magnetism such as earth magnetism or the like is fixedly secured to neck side of the mask frame 6.

According to the above-mentioned color cathode ray tube, an image display having a high definition in a so-called "wide screen" which has a screen with an effective diagonal dimension of, for example, 51 cm can be realized. However, it is needless to say that the present invention is applicable to color cathode ray tubes having diagonal dimensions other than the above-mentioned dimension.

As has been explained heretofore, according to one embodiment of the present invention, by setting the total length of the focus electrode divided in multi-stages within a given value and by properly selecting the mounting position and the sensitivity of the electrostatic quadrupole lens, it becomes possible to provide the color cathode ray tube having the electron gun which has improved the focusing characteristics in the wide area of the phosphor screen.

What is claimed is:

1. A color cathode ray tube having a vacuum envelope which comprises a panel having a phosphor screen on an inner surface thereof, a neck accommodating an electron gun which emits a plurality of electron beams in the horizontal direction and a funnel connecting said panel and said neck, and said color cathode ray tube externally mounting a deflection device which deflects said electron beams in the horizontal direction and the vertical direction at said neck side of said funnel, wherein said electron gun is arranged with a beam generating part which is constituted of a cathode, a control electrode and an accelerating electrode and generates the plurality of electron beams, and a main lens part which is made of a focus electrode and an anode therein and focuses the electron beams generated by said beam generating part toward said phosphor screen, in the tube axis direction, a final-stage main lens is constituted between an anode-side end portion of said focus electrode and a focus electrode side end portion of said anode, said focus electrode includes a plurality of electrode members which constitute an electrostatic quadrupole lens for changing a cross-sectional shape of the electron beams in synchronism with the deflection of said electron beams and an electron lens whose focusing force is fluctuated in synchronism with the deflection of said electron beams, said electron lens is arranged between said electrostatic quadrupole lens and said final-stage main lens, and assuming the distance from said anode-side end portion of the focus electrode to an anode-side end portion of the electrostatic quadrupole lens as L2 (mm), a following relationship is set with respect to the distance L2

$$7.55 \leqq L2 \leqq 11.5.$$

2. A color cathode ray tube according to claim 1, wherein in said focus electrode, a surface of one electrode member which constitutes said electrostatic quadrupole lens and faces the other electrode member in an opposed manner is provided with longitudinally elongated electron beam passing apertures which have a long axis in the vertical direction, and a surface of the other electrode member which constitutes said electrostatic quadrupole lens and faces one electrode member in an opposed manner is provided with a plural pairs of horizontal correction electrode plates which are formed such that said electrode plates sandwich a plurality of respective electron beams from the vertical direction and are protruded in the tube axis direction.

3. A color cathode ray tube according to claim 1, wherein in said focus electrode, a surface of one electrode member which constitutes said electrostatic quadrupole lens and faces the other electrode member in an opposed manner is provided with longitudinally elongated electron beam passing apertures which have a long axis in the vertical direction, and a surface of the other electrode member which forms the electrostatic quadrupole lens and faces one electrode member in an opposed manner is provided with laterally elongated electron beam passing apertures which have a horizontal long axis.

4. A color cathode ray tube according to claim 1, wherein in said focus electrode, a surface of one electrode member which constitutes said electrostatic quadrupole lens and faces the other electrode member in an opposed manner is provided with vertical correction electrode plates which sandwich a plurality of respective electron beams from the horizontal direction and are protruded along the tube axis, and a surface of the other electrode member which constitutes said electrostatic quadrupole lens and faces one electrode member in an opposed manner is provided with horizontal correction electrode plates which sandwich a plurality of respective electron beams from the vertical direction, are protruded along the tube axis and are superposed with said vertical correction electrode plates.

5. A color cathode ray tube according to claim 3, wherein in said electrostatic quadurpole constituted of one electrode member and the other electrode member, the distance defined between a surface of one electrode member which faces the other electrode member in an opposed manner and a surface of the other electrode member which faces one electrode member in an opposed manner is set to not more than 1 mm.

6. A color cathode ray tube according to claim 2, wherein protruding ends of said horizontal correction electrode plates are inserted into said electron beam passing apertures in said one electrode member in the vicinity of both ends thereof in the long axis direction.

7. A color cathode ray tube according to claim 2, wherein assuming an electrode length in the tube axis direction of said horizontal correction electrode plates as L5 and a distance in the vertical direction of a pair of horizontal correction electrode plates as L6, a following relationship is set $$0.0206 \leqq L5/(L6^{2.7}) \leqq 0.0306.$$

8. A color cathode ray tube according to claim 4, wherein assuming an electrode length in the tube axis direction of said vertical correction electrode plates as L3 and an electrode length in the tube axis direction of said horizontal correction electrode plates as L4, a following relationship is set $$2.18 \leqq (L3+L4)/2 \leqq 2.78.$$

9. A color cathode ray tube according to claim 3, wherein assuming a width of end portions in the longitudinal direction of said longitudinally elongated electron beam passing apertures formed in the surface of said one electrode member which faces the other electrode member in an opposed manner as W1 and a width of end portions in the lateral direction of the laterally elongated electron beam passing apertures formed in the surface of the other electrode member which faces one electrode member in an opposed manner as W2, a following relationship is set $$2.00 \leqq (W1+W2)/2 \leqq 3.60.$$

10. A color cathode ray tube according to claim 1, wherein the electron lens whose focusing force is fluctuated in synchronism with the deflection of the electron beams is a curvature-of-image-field correction lens.

11. A color cathode ray tube according to claim 1, wherein a gap of the electron lens whose focusing force is fluctuated in synchronism with the deflection of the electron beams is not less than 0.3 mm.

12. A color cathode ray tube according to claim 1, wherein the distance from a cathode-side end portion of the electron lens whose focusing force is fluctuated in synchronism with the deflection of the electron beams to the anode-side end portion of the electrostatic quadrupole lens is set to not less than 1.5 mm.

13. A color cathode ray tube having a vacuum envelope which comprises a panel having a phosphor screen on an inner surface thereof, a neck accommodating an electron gun which emits three electron beams in the horizontal direction and a funnel connecting said panel and said neck, and said color cathode ray tube externally mounting a deflection device which deflects said electron beams in the horizontal direction and the vertical direction at said neck side of said funnel, wherein said electron gun is arranged with a beam generating part which is constituted of a cathode, a control electrode and an accelerating electrode and generates the three electron beams, and a main lens part which is made of a focus electrode and an anode therein and focuses the electron beams generated by said beam generating part toward said phosphor screen, in the tube axis direction, said focus electrode includes a plurality of electrode members which constitute electrostatic quadrupole lenses for changing a cross-sectional shape of the electron beams in synchronism with the deflection of said electron beams in a plural stages, and assuming the distance from an anode-side end portion of the focus electrode to an anode-side end portion of the electrostatic quadrupole lens at a position closest to the anode as L2 (mm), a following relationship is set with respect to the distance L2

$$7.55 \leqq L2 \leqq 11.5.$$

14. A color cathode ray tube according to claim 13, wherein the focus electrode includes not less than three electrode members.

15. A color cathode ray tube according to claim 14, wherein among said not less than three electrode members, an electrode member which is arranged at a position closest to the phosphor screen is a cup-shaped electrode.

16. A color cathode ray tube according to claim 15, wherein a single opening which is common to the three electron beams is formed in an anode-side end portion of the electrode member arranged at the position closest to the phosphor screen.

17. A color cathode ray tube according to claim 16, wherein a plate-like inner electrode forming a plurality of electron beam passing apertures is provided in the inside of the electrode member arranged at the position closest to the phosphor screen and at a position retracted in the cathode direction from the anode-side end portion of the electrode member.

18. A color cathode ray tube according to claim 17, wherein a guide electrode having a plurality of electron beam passing apertures is provided in a cathode-side end portion of the electrode member arranged at the position closest to the phosphor screen.

19. A color cathode ray tube according to claim 17, wherein a retraction quantity of the inner electrode is set to not less than 3.5 mm.

20. A color cathode ray tube according to claim 18, wherein the length in the tube axis direction of the electrode member arranged at the position closest to the phosphor screen is set to not less than 5.75 mm.

* * * * *